US005275929A

United States Patent [19]

Buitano et al.

[11] Patent Number: 5,275,929

[45] Date of Patent: Jan. 4, 1994

[54] PHOTOGRAPHIC SILVER HALIDE MATERIAL COMPRISING TABULAR GRAINS OF SPECIFIED DIMENSIONS

[75] Inventors: Lois A. Buitano; Allan F. Sowinski; James P. Merrill; Richard P. Szajewski, all of Rochester, N.Y.

[73] Assignee: Eastman Kodak Company, Rochester, N.Y.

[21] Appl. No.: 869,984

[22] Filed: Apr. 16, 1992

[51] Int. Cl.[5] ..... G03C 1/005

[52] U.S. Cl. ..... 430/567; 430/505; 430/510; 430/504

[58] Field of Search ..... 430/567, 505, 510, 504

[56] References Cited

U.S. PATENT DOCUMENTS

| | | | |
|---|---|---|---|
| 4,312,941 | 1/1982 | Scharf et al. | 430/510 |
| 4,391,884 | 7/1983 | Meyer et al. | 430/505 |
| 4,439,520 | 3/1984 | Kofron et al. | 430/567 |
| 4,693,964 | 9/1987 | Daubendick | 430/567 |
| 4,740,454 | 4/1988 | Deguchi et al. | 430/567 |
| 4,746,600 | 5/1988 | Watanabe et al. | 430/505 |
| 4,748,106 | 5/1988 | Hayashi | 430/567 |
| 4,775,617 | 10/1988 | Goda | 430/567 |
| 4,833,069 | 5/1989 | Hamada et al. | 430/504 |
| 4,855,220 | 8/1989 | Szajewski | 430/505 |
| 4,956,269 | 9/1990 | Ikeda et al. | 430/505 |

OTHER PUBLICATIONS

Buhr et al, Research Disclosure Item #25330, May 1985, pp. 237-240.

*Primary Examiner*—Charles L. Bowers, Jr.
*Assistant Examiner*—Thomas R. Neville
*Attorney, Agent, or Firm*—Paul A. Leipold

[57] ABSTRACT

A photographic recording material is disclosed which contains tabular silver halide emulsion grains of specified dimensions to enable improved sharpness.

18 Claims, No Drawings

PHOTOGRAPHIC SILVER HALIDE MATERIAL COMPRISING TABULAR GRAINS OF SPECIFIED DIMENSIONS

TECHNICAL FIELD

This invention relates to photographic materials and elements, specifically to materials and elements having tabular silver halide emulsion grains of specified dimensions to enable improved sharpness.

BACKGROUND ART

Among the desirable properties of a photographic silver halide recording material is high sharpness. That is, the recording material should enable faithful reproduction and display of both coarse and fine details of the original scene. This combination of properties has proven difficult to achieve in practice.

A general description of the nature of this problem may be found in T. H. James, ed., "The Theory of the Photographic Process," Macmillan, New York, 1977 and in particular at Chapter 20 of this text, pages 578–591, entitled "Optical Properties of the Photographic Emulsion" by J. Gasper and J. J. DePalma.

One method of improving sharpness, disclosed at U.S. Pat. No. 4,312,941 and at U.S. Pat. No. 4,391,884, involves the incorporation of a spatially fixed absorber dye in a film layer between the exposing light source and a layer comprising a conventional grain light sensitive silver halide emulsion. In these disclosures, the absorber dye is held spatially fixed either by means of a ballast group or by means of a mordanting material incorporated at a specified position in the film structure. Use of this spatial arrangement of absorber dye and emulsion reduces front-surface halation effects.

U.S. Pat. No. 4,439,520, inter alia, discloses the utility of sensitized high aspect ratio silver halide emulsions for use in light sensitive materials and processes. These high aspect ratio silver halide emulsions, herein known as tabular grain emulsions, differ from convention grain emulsions in many characteristics. One differential characteristic is the relationship between the emulsion grain thickness and the emulsion grain equivalent circular diameter. Conventional grain emulsions tend to be isotropic in shape and, when incorporated in a film structure, tend to be randomly oriented within a particular layer. Tabular grain emulsions however, tend to be anisotropic in shape and, when incorporated in a film structure, tend to align such that their major axis parallels the plane of the film base. This degree of anisotropicity is know as the emulsion aspect ratio (AR), typically defined as the ratio of the emulsion grain equivalent circular diameter divided by the emulsion grain thickness. The ability to control emulsion grain thickness and alignment within a film structure can enable the realization of otherwise unattainable degrees of recording material performance.

The optical properties of photographic recording materials incorporating tabular grain emulsions are described in great detail at "Research Disclosure", #25330, May, 1985, as are methodologies of specifying particular arrangements of tabular grain emulsions within a film structure and of specifying particular tabular grain emulsion thicknesses so as to enable the attainment of specifically desired properties, such as speed or sharpness in underlying or overlying emulsion layers. No mention is made of the relationship between tabular grain emulsion thickness and the speed or sharpness of the emulsion layer comprising such a grain.

These methods may not prove to be wholly satisfactory. U.S. Pat. No. 4,740,454, for example, discloses that although high frequency sharpness may be attained by the appropriate choice of tabular grain emulsion thickness and placement, this can be at the cost of low frequency sharpness. The term high frequency sharpness generally relates to the appearance of fine detail in a scene reproduction while the term low frequency sharpness generally relates to the appearance of clarity or "snap" in a scene reproduction. It is now understood that the terms "high frequency sharpness" and "low frequency sharpness" are qualitative in nature and that both image frequency, expressed as cycles/mm in the film plane, and the image magnification employed in producing a reproduction must be taken into account when specifying such terms. This publication discloses that both high frequency and low frequency sharpness may be simultaneously improved by the incorporation of specific mercaptothiadiazole compounds in combination with tabular grain silver halide emulsions. This practice may not be wholly satisfactory since the incorporation of such silver ion ligands can lead to deleterious effects on film speed and film keeping properties.

In a related area, U.S. Pat. Nos. 4,746,600 and 4,855,220 disclose that unexpectedly large degrees of sharpness can be attained by combining spatially fixed absorber dyes and Development Inhibitor Releasing Compounds (DIR Compounds) in a photographic silver halide recording material. The spatially fixed absorber dyes are positioned between an emulsion containing layer and the exposing light source. The materials described in these disclosures incorporate either conventional grain silver halide emulsions or low aspect ratio tabular grain silver halide emulsions. There is no indication of any dependence in film imaging performance on the thickness or spatial positioning of the light sensitive silver halide emulsion grains in these publications.

Again, in a related area, U.S. Pat. No. 4,833,069 discloses that large degrees of sharpness can be attained by simultaneously controlling imaging layer thickness to between 5 and 18 microns and incorporating large quantities, between 15 and 80 mol % of colored cyan dye-forming couplers, known also in the art as cyan dye-forming color masking couplers. This method may not be wholly satisfactory since the use of excessive quantities of color masking couplers can lead to inferior color rendition by over-correcting the color reproduction through excessive use of the masking function. Again, there is no indication of any dependence in film imaging performance on the thickness or spatial positioning of the light sensitive silver halide emulsion grains in this publication.

In yet another related area, U.S. Pat. No. 4,956,269 discloses that color reversal silver halide photographic materials incorporating tabular grain silver halide emulsions can show improved sharpness when the photographic layer incorporating the tabular grain silver halide emulsion also incorporates a quantity of absorber dye sufficient to reduce the speed of that layer by at least 20%, when the total imaging layer thickness is less than 16 microns and when the swell ratio of the film is greater than 1.25. The materials described in this disclosure incorporate intermediate aspect ratio ($AR<9.0$) tabular grain silver halide emulsions. These conditions and constraints are non-predictive of the performance of color negative silver halide photographic materials.

A color negative silver halide photographic recording material incorporating conventional (non-tabular) grain silver halide emulsions and a quantity of distributed dye sufficient to reduce the speed of a color record by about 50% has been commercially available for many years. Additionally, it has been common practice in the photographic art to commercially provide silver halide photographic recording materials incorporating conventional grain and/or tabular grain silver halide emulsions in combination with soluble dyes sufficient to reduce the speed of a color record by about 10% for purposes related to ease of manufacture. Likewise, color negative silver halide photographic materials incorporating high aspect ratio tabular grain silver halide emulsions with an average grain thickness of circa 0.11 and 0.14 microns in an intermediately positioned layer have been commercially available for many years.

The thicknesses of the silver halide emulsions employed in this invention are adjusted for the purposes of improving film performance according to principles described in *Research Disclosure,* May, 1985, Item 25330. This disclosure teaches, by extrapolation from the optical properties of silver bromide sheet crystals, that the thicknesses of silver halide emulsions incorporated in specific photographic layers and sensitized to one spectral region may be chosen to enable either improved speed or improved sharpness behavior in other photographic layers incorporating silver halide emulsions sensitized to different regions of the spectrum. These improvements are said to occur because the light transmission and reflection properties of the silver halide emulsions are controlled in large part by their grain thicknesses. Further discussion on the relationship between the thickness of silver halide crystals and their reflectance properties can be found in *Optics,* by J. M. Klein, John Wiley & Sons, New York, 1960, pages 582 to 585. These disclosures make no teaching about the relationship between the thickness of a silver halide emulsion sensitized to a particular region of the spectrum and the sharpness behavior of a photographic layer or element using such an emulsion.

Despite all of this effort, fully adequate degrees of sharpness have not been attained in silver halide photographic materials comprising high aspect ratio tabular grain emulsions.

DISCLOSURE OF INVENTION

It is an object of the invention to overcome disadvantages of prior photographic materials.

It is another object of this invention to provide a silver halide photographic recording material incorporating high aspect ratio tabular grain silver halide emulsions showing excellent sharpness performance.

These and other objects of the invention are generally accomplished by providing photographic recording material comprising a support bearing a photographic layer comprising a sensitized high aspect ratio tabular grain silver halide emulsion wherein the thickness of said silver halide emulsion grains is chosen so as to minimize the spectral reflectance in the region of the spectrum where the emulsion has it's maximum sensitivity.

In a preferred embodiment, the color photographic recording material comprises at least three photographic elements each said element being sensitized to different regions of the spectrum;

wherein the most light sensitive layer of at least one photographic element comprises a sensitized high aspect ratio tabular grain silver halide emulsion;

wherein said most light sensitive layer of said at least one element is positioned furthest from the exposing image source of all of the most light sensitive layers sensitized to other regions of the spectrum and present in other elements; and wherein the thickness of said tabular silver halide emulsion grains is chosen so as to minimize the spectral reflectance in the region of the spectrum to which said emulsion is sensitized.

MODES FOR CARRYING OUT THE INVENTION

In accordance with the invention, it has now been found that the sharpness of a photographic element can be unexpectedly improved by setting the thickness of the sensitized high aspect ratio tabular grain emulsion utilized in a most sensitive layer of that element such that the reflection in the region of the spectrum to which that emulsion is sensitized is at a minimum. The thickness of the emulsion is designed to minimize the reflectance of the color intended to be absorbed. In a photographic material the "most sensitive layer" in an element is the layer that comprises the silver halide most sensitive to the spectral region to which the element as a whole is sensitized. As used herein, the term "upper surface" or top refers to the surface directed toward the exposure light, while the lower portion or bottom of the photographic element is that portion towards the base and away from the direction of exposure.

It is preferred that the most sensitive layer comprising a high aspect ratio tabular grain silver halide emulsion in which the thickness of said emulsion is chosen so as to minimize reflectance in the region of the spectrum to which the emulsion is sensitized be further from the image exposure source than another most sensitive layer of an element which comprises a high aspect ratio tabular grain emulsion sensitized to a different region of the spectrum.

Thus, to improve sharpness in a blue sensitized element which incorporates a blue sensitized emulsion with a peak sensitivity at about 450 nm used in a most blue sensitive layer, an emulsion grain thickness of between 0.08 and 0.10 microns is preferred. An emulsion grain thickness close to the center of this range, i.e. 0.09 microns is more preferred because this best serves to minimize light reflection at 450 nm. An emulsion grain thickness of between 0.19 and 0.21 microns can also be used to advantage in this instance because this thickness again corresponds to a minimum in light reflection at about 450 nm.

In a like manner, to improve sharpness in a green sensitized element which incorporates a green sensitized emulsion with a peak sensitivity at about 550 nm used in a most green sensitive layer, an emulsion grain thickness of between 0.11 and 0.13 microns is preferred because this thickness lowers green light reflection. An emulsion grain thickness close to the center of this range, i.e. 0.12 microns is more preferred because this thickness corresponds to a minimum in green light reflection. An emulsion grain thickness of between 0.23 and 0.25 microns can also be used to advantage in this instance because this thickness again corresponds to a minimum in light reflection at about 550 nm.

In a similar vein, to improve sharpness in a red sensitized element which incorporates a red sensitized emulsion with a peak sensitivity at about 650 nm used in a most red sensitive layer, an emulsion grain thickness of between 0.14 and 0.17 microns is preferred because this thickness lowers red light reflection. An emulsion grain thickness close to the center of this range, i.e. 0.15 microns is more preferred because this thickness corresponds to a minimum in reflecting light of 650 nm. An emulsion grain thickness of between 0.28 and 0.30 microns can also be used to advantage in this instance.

It is straightfoward to choose emulsion grain thicknesses to improve the sharpness behavior of emulsions sensitized to other regions of the spectrum or with peak sensitivity at different wavelengths according to this invention by following the disclosed pattern.

Thus, for an infra-red sensitized emulsion with peak sensitivity at 750 nm, an emulsion grain thickness of between 0.17 and 0.19 microns would be chosen, while for a blue-green sensitized emulsion with peak sensitivity at 500 nm, an emulsion grain thickness of between 0.10 and 0.12 microns would be chosen. Therefore, the pattern is to choose grain thicknesses which minimize light reflection at the sensitization wavelength maximum following the sinusoidal variations described in *Research Disclosure,* Item 25330, May 1985.

When a photographic element is comprised of more than one photographic layer, it is additionally preferred that the thickness of the silver halide emulsions used in such layers be also chosen so as to minimize reflection in the region of the spectrum to which the emulsion in that layer is sensitized.

Even when the thickness of a silver halide emulsion employed in a most sensitive layer is not chosen according to this pattern, it may be useful to choose the thickness of an emulsion used in a less sensitive layer to be the thickness light reflective of light of the wavelength of the most sensitive layer.

The photographic materials of this invention can be either single color or multicolor materials. Multicolor materials typically contain dye image-forming elements sensitive to each of the three primary regions of the spectrum. In some cases the multicolor material may contain elements sensitive to other regions of the spectrum or to more than three regions of the spectrum. Each element can be comprised of a single emulsion layer or of multiple emulsion layers sensitive to a given region of the spectrum. The layers of the material, including the layers of the image-forming elements, can be arranged in various orders as known in the art.

A typical multicolor photographic material comprises a support bearing a cyan dye image-forming element comprising at least one red-sensitive silver halide emulsion layer having associated therewith at least one cyan dye-forming coupler, a magenta image forming element comprising at least one green-sensitive silver halide emulsion layer having at least one magenta dye-forming coupler and a yellow dye image-forming element comprising at least one blue-sensitive silver halide emulsion layer having associated therewith at least one yellow dye-forming coupler. In some instances it may be advantageous to employ other pairings of silver halide emulsion sensitivity and dye image-forming couplers, as in the pairing of an infra-red sensitized silver halide emulsion with a magenta dye-forming coupler or in the pairing of a blue-green sensitized emulsion with a coupler enabling minus-cyan dye formation. The material can contain additional layers, such as filter layers, interlayers, overcoat layers, subbing layers, and the like. The layers of the material above the support typically have a total thickness of between about 5 and 30 microns. The total silver content of the material is typically between 1 and 10 grams per $m^2$.

The sensitized high aspect ratio tabular grain silver halide emulsions useful in this invention include those disclosed by Kofron et alia in U.S. Pat. No. 4,439,520 and in the additional references cited below. These high aspect ratio tabular grain silver halide emulsions and other emulsions useful in the practice of this invention can be characterized by geometric relationships, specifically the Aspect Ratio and the Tabularity. The Aspect Ratio (AR) and the Tabularity (T) are defined by the following equations:

$$AR = \frac{\text{Equivalent Circular Diameter}}{\text{Thickness}}$$

$$T = \frac{\text{Equivalent Circular Diameter}}{\text{Thickness} \times \text{Thickness}}$$

where the equivalent circular diameter and the thickness of the grains, measured using methods commonly known in the art, are expressed in units of microns.

High Aspect Ratio Tabular Grain Emulsions of this invention are preferred to have an AR greater than 10. These preferred useful emulsions additionally can be characterized in that their Tabularity is greater than 25 and they are preferred to have a tabularity greater than 50.

Examples illustrating the preparation of such useful emulsions will be shown below.

In the following discussion of suitable compounds for use in the material of this invention, reference will be made to *Research Disclosure,* December 1989, Item 308119, published by Kenneth Mason Publications, Ltd., The Old Harbourmaster's 8 North Street, Emsworth, Hampshire P010 7DD, ENGLAND, the disclosure of which are incorporated herein by reference. This publication will be identified hereafter by the tern "Research Disclosure".

The silver halide emulsions employed in the material of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, for at least one layer of the invention elements, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966, and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in G. B. Patent 1,027,146; Japanese 54/48521; U.S. Pat. No. 4,379,837; U.S. Pat. No. 4,444,877; U.S. Pat. No. 4,665,012; U.S. Pat. No. 4,686,178; U.S. Pat. No. 4,565,778; U.S. Pat. No. 4,728,602; U.S. Pat. No. 4,668,614; U.S. Pat. No. 4,636,461; EP 264,954; and U.S.

Ser. No. 842,683 of Antoniades et al filed Feb. 27, 1992. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines, and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* Item 308119, cited above, Section IV.

The spatially fixed dyes useful in this invention are well known in the art. These spatially fixed dyes are also known as non-diffusible dyes and as anti-halation dyes. Typical examples of spatially fixed dyes, their preparation and methods of incorporation in photographic materials are disclosed in U.S. Pat. Nos. 4,855,220; 4,756,600; and 4,956,269, as well as by commercially available materials. Other examples of spatially fixed dye are disclosed at Section VIII of Research Disclosure.

The spatially fixed dye absorbs light in the region of the spectrum to which the high aspect ratio tabular grain silver halide layer of the invention is sensitized. While the dye will generally absorb light primarily only in that region, dyes that absorb light in other regions of the spectrum as well as the region to which the silver halide is sensitized are also included within the scope of the invention. A simple test as to whether the spatially fixed dye is suitable with the invention is if the speed of the silver halide layer of the invention is less when the dye is present than when it is not, then the dye is suitable.

By spatially fixed, it is meant that substantially none of the dye will migrate out of the layer in which it has been incorporated before the photographic material has been processed.

These dyes may be ballasted to render them non-diffusible or they may be intrinsically diffusible but rendered non-diffusible by use of organic mordanting materials, such as charged or uncharged polymeric matrixes, or rendered non-diffusible by adhesion to inorganic solids such as silver halide, or organic solids all as known in the art. Alternatively, these dyes may be incorporated in polymeric latexes. These dyes may additionally be covalently bound to polymeric materials.

These dyes may retain their color after processing or may change in color, be decolorized or partially or completely removed from the photographic material during processing. For ease of direct viewing or optical printing it may be preferred that the dyes be removed from the material or be rendered non-absorbing in the visible region during or after processing. During photographic development (generally in high pH, e.g. 9 or above, sulfite containing processing solution), bleaching (in iron containing or persulfate or other peroxy containing solutions at lower pH, e.g. 7 or below) or fixing, the dye may be decolorized or removed from the material. In photographic materials where the image may be electronically scanned or digitally manipulated, the material may or may not retain some degree of coloration depending on the intended use.

The spatially fixed dye may be a diffusible acidic dye that is rendered non-diffusible by incorporating a base group-containing polymeric mordant for the dye at a specified position in the photographic material. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art. Polymer mordants are well known in the art and are described, for example in U.S. Pat. Nos. 2,548,564; 2,675,316; 2,882,156 and 3,706,563 as well as in Research Disclosure, Section VIII.

The spatially fixed dye may also be a solid particle dispersion of a loaded polymer latex of a dye that is insoluble at coating pH but soluble at processing pH's as described in U.S. Pat. No. 4,855,211—Factor et al.

Additionally, the dye may be a colored image dye-forming coupler as disclosed in Research Disclosure, Section VII. The color of such a dye may be changed during processing. The dye may be a pre-formed image coupler dye which would generally remain in the material during processing. The dye may also be a spectral sensitizing dye immobilized by adsorption to chemically unsensitized silver halide. Such a dye would generally be removed from the material during the bleaching or fixing step.

It is preferred that such spatially fixed dyes be positioned closer to the image exposure source than the photographic layer comprising a high aspect ratio tabular grain silver halide emulsion sensitized to a region of the spectrum where such dyes absorb light.

Examples of useful dyes include the dye materials described in the photographic examples illustrating the practice of this invention, in the disclosures cited earlier and include the structures shown below.

CM-1
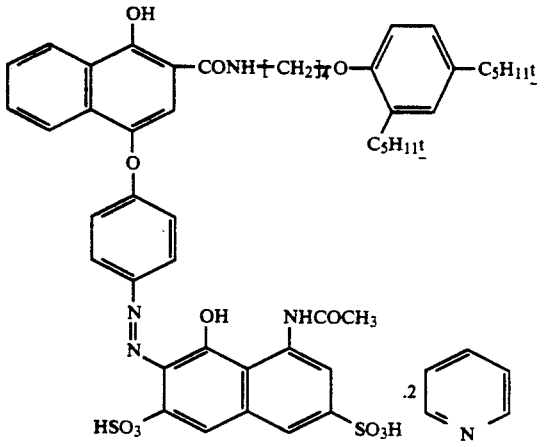
MM-1
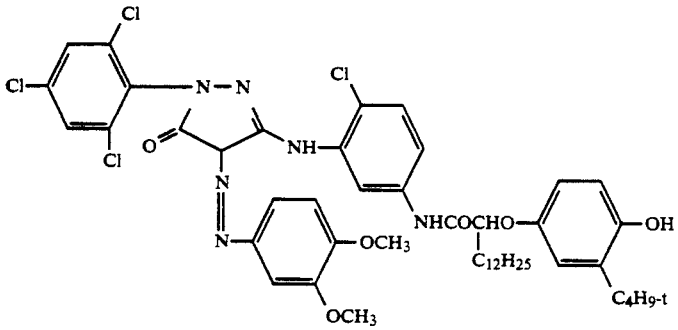
MM-2
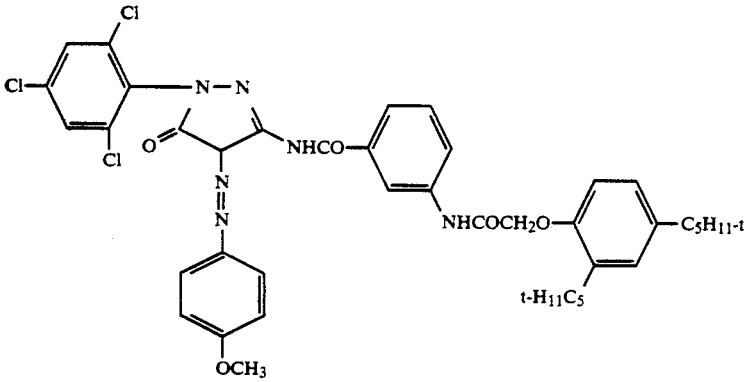
CD-1
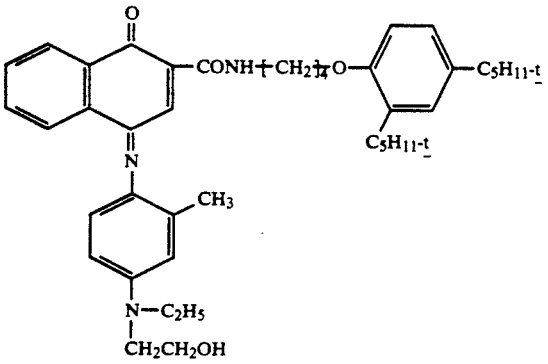

-continued
MD-1
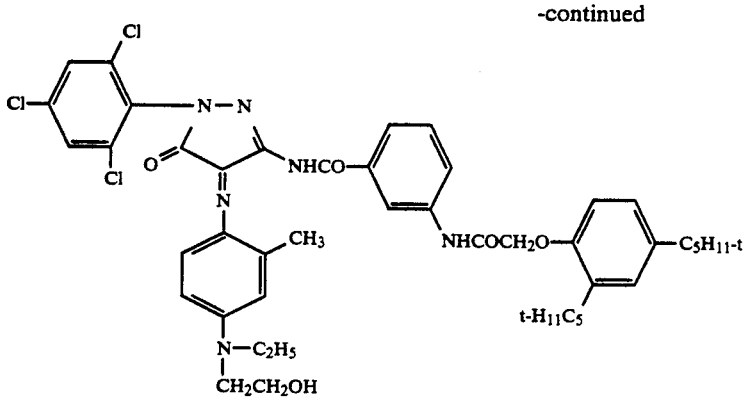
YD-1
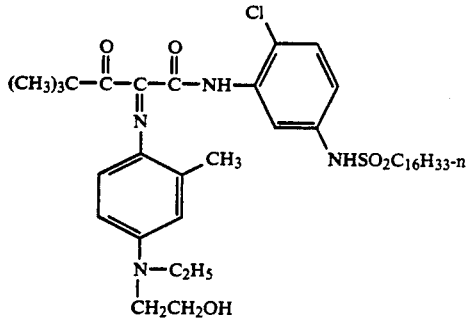
YD-2
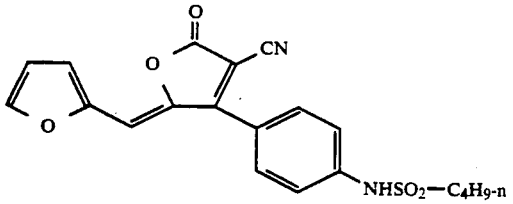
SOL-M1
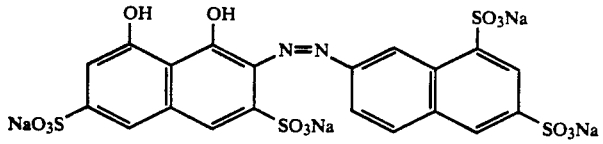
SOL-C1
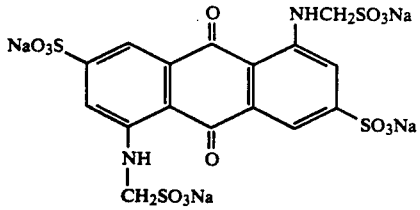
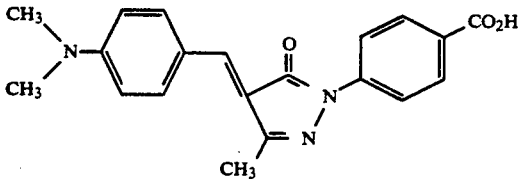
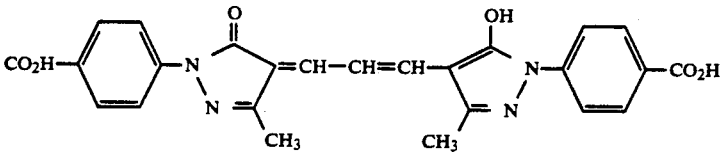

-continued
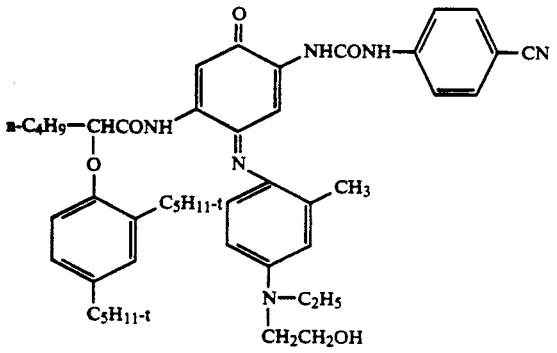
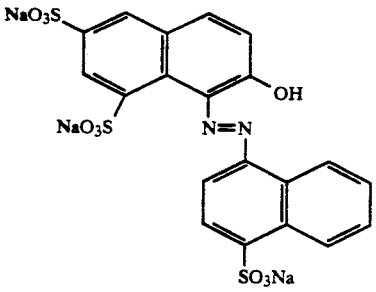
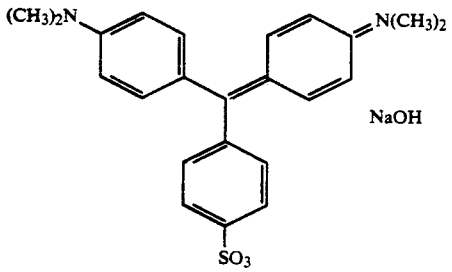
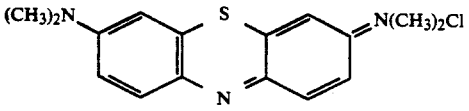
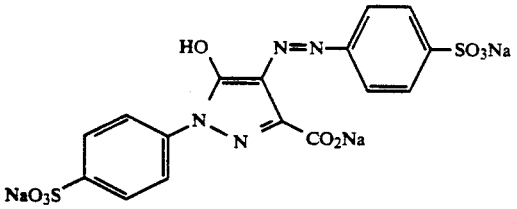
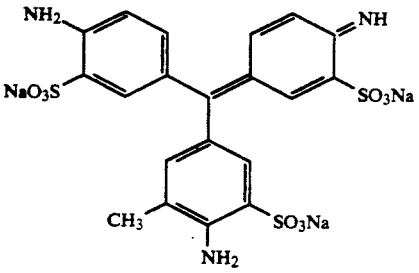
Other useful dye structures include but are not limited to

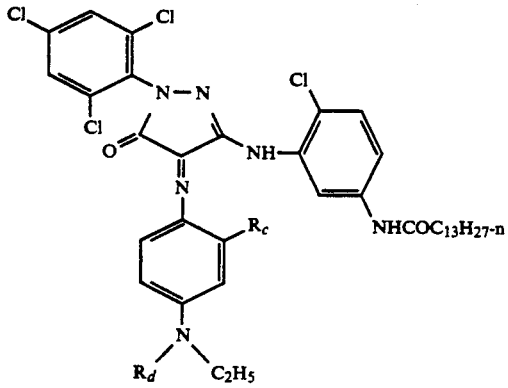

where $R_c$=—H or —$CH_3$, and $R_d$=—H; —$CH_2CH_2OH$; —$CH_2CH_3$; or —$CH_2CH_2$—NH Examples of polymer mordants useful in combination with diffusible acidic dyes in elements of the present invention include the following:

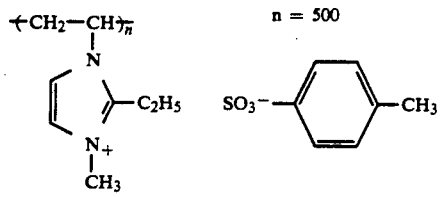

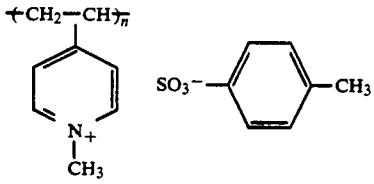

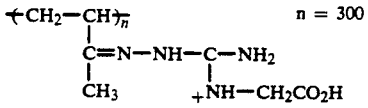

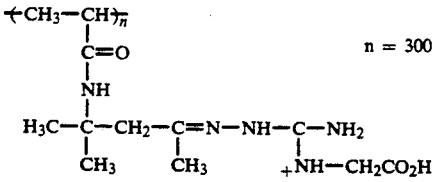

Alternatively, it may be desirable to employ anionically charged polymers in combination with diffusible cationic dyes.

The distributed dyes that may be used with the emulsion layers of this invention may be any of the soluble dyes known in the art as disclosed commercially, in U.S. Pat. Nos. 4,855,220; 4,756,600; and 4,956,269, or at Section VIII of Research Disclosure cited earlier.

By distributed, it is meant that quantities of the dye (or a dye combination) which absorbs light in the region of the spectrum to which the high aspect ratio tabular grain silver halide layer of the invention is sensitized are present in several of the layers of the photographic material before the exposure of said material.

It is preferred that such distributed dyes be positioned both closer to, coincident with and further from the image exposure source than the photographic layer comprising a high aspect ratio tabular grain silver halide emulsion sensitized to a region of the spectrum where such dyes absorb light.

These soluble dyes may be diffusible and have the property of distributing within the structure of a photographic material to a greater or lesser extent during a wet coating procedure or during a subsequent curing or storage procedure. Alternatively, these dyes may be added to a photographic material in a subsequent coating, imbibing or like procedure as known in the art. These soluble dyes may additionally be caused to distribute in specific patterns within a photographic material by the addition of mordanting materials in appropriate quantities and positions within the structure of the photographic material. The mordanting material may be the charged or uncharged polymeric materials described earlier. Alternatively, the distribution of the dye may be controlled by the quantity and disposition of hydrophobic organic materials such as couplers or coupler solvents or absorbent charged or uncharged inorganic materials such as silver halide and the like within the coating structure.

Alternatively, non-diffusible dyes may be employed. These may include any of the non-diffusible dyes previously described. When non-diffusible dyes are employed they may be distributed within a photographic material by addition of a portion of each to the photographic layers as they are coated.

The dye absorbs light in the region of the spectrum to which the high aspect ratio tabular grain silver halide layer of the invention is sensitized. While the dye will generally absorb light primarily only in that region, dyes that absorb light in other regions of the spectrum as well as the region to which the silver halide is sensitized are also included within the scope of the invention. A simple test as to whether the distributed dye is within the scope of the invention is if the speed of the silver halide layer of the invention is reduced by at least 20% by the presence of the distributed dye, then the distributed dye is within the scope of the invention.

These dyes may retain their color after processing or may change in color, be decolorized or partially or completely removed from the photographic material during processing. For ease of direct viewing or optical printing it may be preferred that the dyes be removed from the film or rendered non-absorbing in the visible region during or after processing. During photographic development (generally in high pH, e.g. 9 or above, sulfite containing processing solution), bleaching (in iron containing or persulfate or other peroxy containing solutions at lower pH, e.g. 7 or below) or fixing, the dye may be decolorized or removed from the material. In photographic materials where the image may be electronically scanned or digitally manipulated, the material may or may not retain some degree of coloration depending on the intended use.

The distributed dye may be a diffusible acidic dye. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art.

Specific examples of distributed dyes are shown in the literature cited earlier, in the discussion of spatially fixed dyes and in the examples illustrating the practice of the invention.

It has also been found that both the speed and sharpness of a first photographic element wherein the most light sensitive layer of that first element comprises a high aspect ratio silver halide emulsion whose thickness has been chosen so as to minimize reflection in the region of the spectrum to which that emulsion is sensitized can be unexpected and simultaneously improved when the photographic material additionally comprises a second photographic element sensitized to a different region of the spectrum wherein the most light sensitive layer of said second element is positioned closer to the image exposure source than the most light sensitive layer of said first element and the most light sensitive layer of said second element additionally comprises a high aspect ratio tabular grain emulsion whose thickness is also chosen to minimize the reflectance in the region of the spectrum to which the first element is sensitive.

Thus, to improve speed and sharpness in a red light sensitive element which comprises a high aspect ratio tabular grain silver halide emulsion with a peak sensitivity at about 650 nm used in a most red sensitive layer, in a photographic material comprising a most green light sensitive layer positioned closer to an image exposure source than the most red light sensitive layer, it is preferred to choose the thickness of the sensitized high aspect ratio tabular grain emulsions employed in both of said most sensitive layers to be between 0.14 and 0.17 microns. An emulsion grain thickness close to the center of this range, 0.15 microns is more preferred. An emulsion grain thickness of between 0.28 and 0.30 microns can also be used to advantage in this instance.

Likewise, to improve speed and sharpness in a red light sensitive element which comprises a high aspect ratio tabular grain silver halide emulsion with a peak sensitivity at about 650 nm used in a most red sensitive layer, in a photographic material comprising a most blue light sensitive layer positioned closer to an image exposure source than the most red light sensitive layer, it is preferred to choose the thickness of the sensitized high aspect ratio tabular grain emulsions employed in both of said most sensitive layers to be between 0.14 and 0.17 microns. An emulsion grain thickness close to the center of this range, 0.15 microns is more preferred. An emulsion grain thickness of between 0.28 and 0.30 microns can also be used to advantage in this instance.

In a similar vein, to improve speed and sharpness in a green light sensitive element which comprises a high aspect ratio tabular grain silver halide emulsion with a peak sensitivity at about 550 nm used in a most green sensitive layer, in a photographic material comprising a most red light sensitive layer positioned closer to an image exposure source than the most green light sensitive layer, it is preferred to choose the thickness of the sensitized high aspect ratio tabular grain emulsions employed in both of said most sensitive layers to be between 0.11 and 0.13 microns. An emulsion grain thickness close to the center of this range, 0.12 microns is more preferred. An emulsion grain thickness of between 0.23 and 0.25 microns can also be used to advantage in this instance.

Other combinations of two or more high aspect ratio tabular grain emulsions sensitized to different regions of the spectrum and employed in different most sensitive layers of different elements can be obviously derived based on the above disclosure and pattern of preferred thicknesses.

It is especially preferred in a photographic material sensitive to three regions of the spectrum to employ sensitized high aspect ratio tabular grain emulsions whose thicknesses are chosen so as to minimize the reflectance in the region of the spectrum to which the emulsion employed in the most sensitive layer positioned furthest from the image source of all of the most sensitive layers is sensitized.

It is straightfoward to choose emulsion grain thicknesses to improve the sharpness behavior of emulsions sensitized to other regions of the spectrum or with peak sensitivity at different wavelengths according to this invention by following the disclosed pattern.

Thus, for an infra-red sensitized emulsion with peak sensitivity at 750 nm, an emulsion grain thickness of between 0.17 and 0.19 microns would be chosen, while for a blue-green sensitized emulsion with peak sensitivity at 500 nm, an emulsion grain thickness of between 0.10 and 0.12 microns would be chosen.

When a photographic element is comprised of more than one photographic layer, it is additionally preferred that the thickness of the silver halide emulsions used in such layers be also chosen so as to minimize reflection in the region of the spectrum to which the emulsion is sensitized.

Even when the thickness of a silver halide emulsion employed in a most sensitive layer is not chosen according to this pattern, it may be useful to choose the thickness of an emulsion used in a less sensitive layer according to the disclosed pattern.

The photographic materials of this invention may advantageously comprise Development Inhibitor Releasing Compounds, also called DIR compounds as known in the art. Typical examples of DIR compounds, their preparation and methods of incorporation in photographic materials are disclosed in U.S. Pat. Nos. 4,855,220 and 4,756,600, as well as by commercially available materials. Other examples of useful DIR compounds are disclosed at Section VIIF of Research Disclosure.

These DIR compounds may be incorporated in the same layer as the high aspect ratio emulsions of this invention, in reactive association with this layer or in a different layer of the photographic material, all as known in the art.

These DIR compounds may be among those classified as "diffusible," meaning that they enable release of a highly transportable inhibitor moiety or they may be classified as "non-diffusible" meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U. K. Patent No. 2,099,167; European Patent Application 167,168; Japanese Kokai 205150/83 or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, as for example a yellow dye-forming DIR coupler with a green sensitized emulsion, all as known in the art.

The DIR compounds may also be incorporated in reactive association with bleach accelerator releasing couplers as disclosed in U.S. Pat. No. 4,912,024, and in U.S. application Ser. No. 563,725 filed Aug. 8, 1990 and U.S. Pat. No. 5,135,389.

Specific DIR compounds useful in the practice of this invention are disclosed in the above cited references, in commercial use and in the examples demonstrating the practice of this invention which follow. The structures of other useful DIR compounds are shown below.
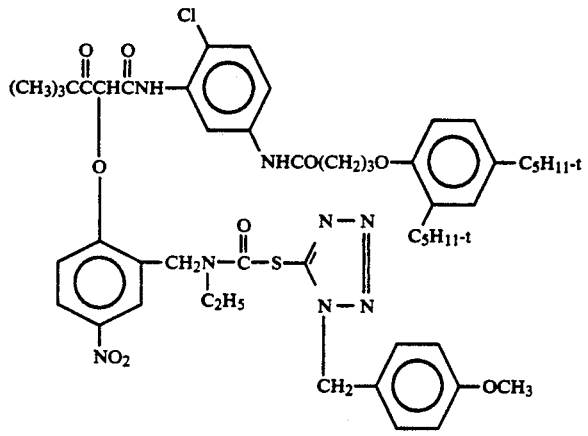
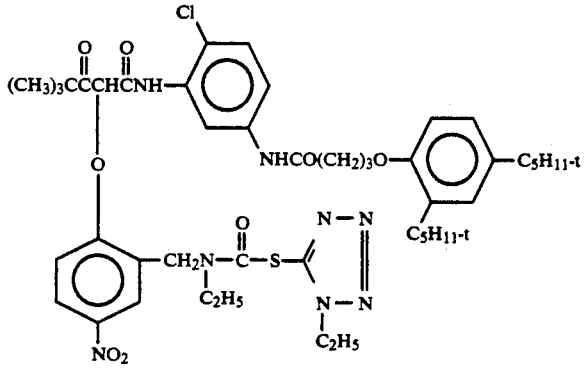
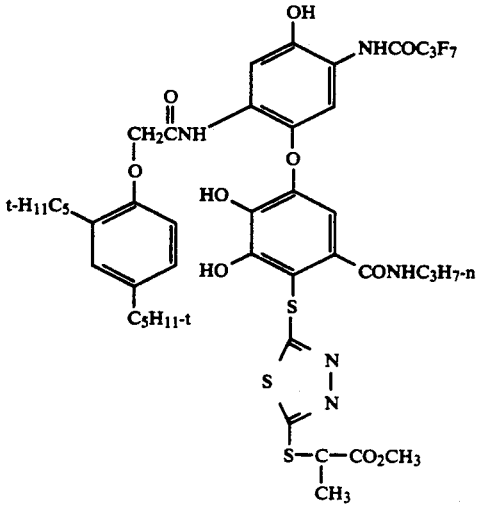

-continued
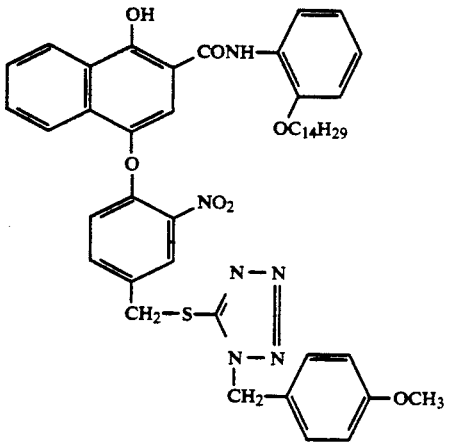
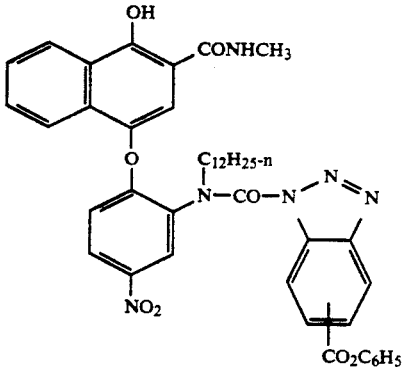
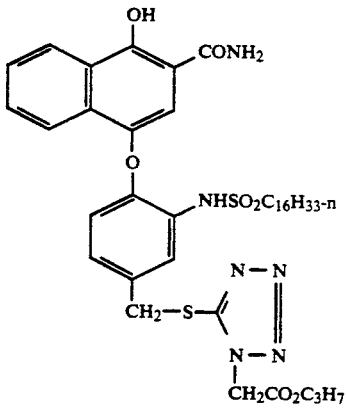
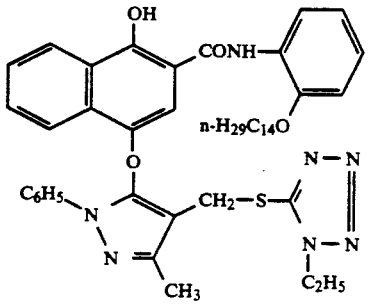

-continued

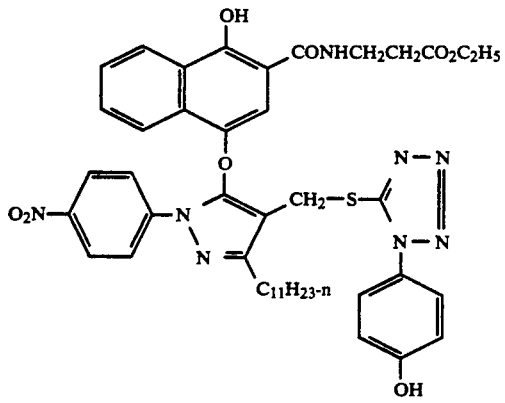

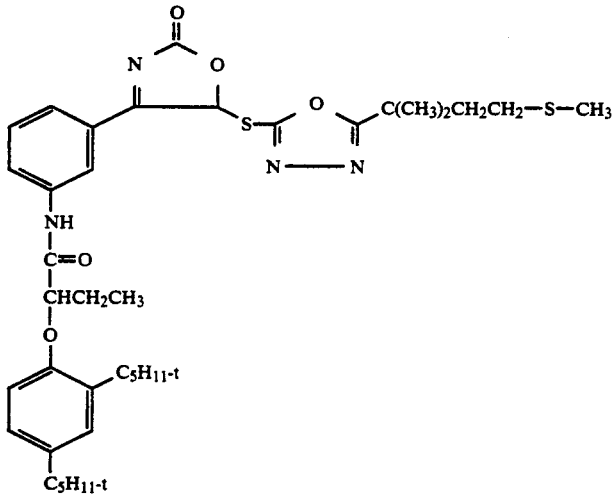

Suitable vehicles for the emulsion layers and other layers of photographic materials of this invention are described in *Research Disclosure* Item 308119, Section IX, and the publications cited therein.

In addition to the couplers described herein, the materials of this invention can include additional couplers as described in *Research Disclosure* Section VII, paragraphs D, E, F, and G, and the publications cited therein. These additional couplers can be incorporated as described in *Research Disclosure* Section VII, paragraph C, and the publications cited therein.

The photographic materials of the invention may also comprise Bleach Accelerator Releasing (BAR) compounds as described in European Patents 0 193 389 B and 0 310 125; and at U.S. Pat. No. 4,842,994, and Bleach Accelerator Releasing Silver Salts as described at U.S. Pat. Nos. 4,865,956 and 4,923,784 hereby incorporated by reference. Typical structures of such useful compounds include:

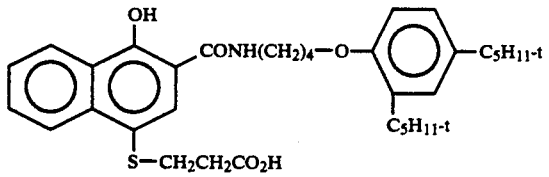

-continued

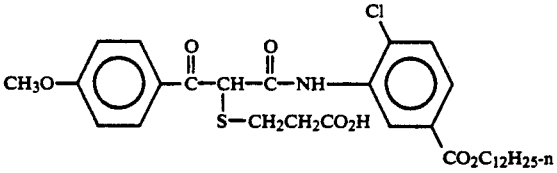

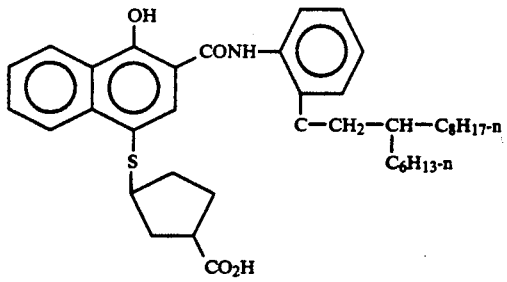

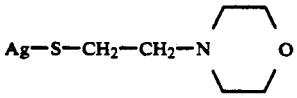

Other useful bleach bleaching and bleach accelerating compounds and solutions are described in the above publications, the disclosures of which are incorporated by reference.

The photographic materials of this invention can be used with colored masking couplers as described in U.S. Pat. Nos. 4,883,746 and 4,833,069.

The photographic materials of this invention can contain brighteners (*Research Disclosure* Section V), antifoggants and stabilizers (*Research Disclosure* Section VI), antistain agents and image dye stabilizers (*Research Disclosure* Section VII, paragraphs I and J), light absorbing and scattering materials (*Research Disclosure* Section VIII), hardeners (*Research Disclosure* Section XI), plasticizers and lubricants (*Research Disclosure* Section XII), antistatic agents (*Research Disclosure* Section XIII), matting agents (*Research Disclosure* Section XVI), and development modifiers (*Research Disclosure* Section XXI).

The photographic materials can comprise polymer latexes as described in U.S. patent application Ser. Nos. 720,359 and 720,360 filed Jun. 25, 1991, and Ser. No. 771,016 filed Oct. 1, 1991, and in U.S. Pat. Nos. 3,576,628; 4,247,627; and 4,245,036, the disclosures of which are incorporated by reference.

The photographic materials can be coated on a variety of supports as described in *Research Disclosure* Section XVII and the references described therein.

Photographic materials can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the material with a color developing agent to reduce developable silver halide and oxidize the color developing agent. Oxidized color developing agent in turn reacts with the coupler to yield a dye.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing to remove silver and silver halide, washing, and drying.

Typical bleach baths contain an oxidizing agent to convert elemental silver, formed during the development step, to silver halide. Suitable bleaching agents include ferricyanides, dichromates, ferric complexes of aminocarboxylic acids, such as ethylene diamine tetraacetic acid and 1,3-propylene diamine tetraacetic acid as described at *Research Disclosure,* Item No. 24023 of April, 1984. Also useful are peroxy bleaches such as persulfate, peroxide, perborate, and percarbonate. These bleaches may be most advantageously employed by additionally employing a bleach accelerator releasing compound in the film structure. They may also be advantageously employed by contacting the film structure with a bleach accelerator solution during photographic processing. Useful bleach accelerator releasing compounds and bleach accelerator solutions are discussed in European Patents 0 193 389B and 0 310 125A; and in U.S. Pat. Nos. 4,865,956; 4,923,784; and 4,842,994, the disclosures of which are incorporated by reference.

Fixing baths contain a complexing agent that will solubilize the silver halide in the element and permit its removal from the element. Typical fixing agents include thiosulfates, bisulfites, and ethylenediamine tetraacetic acid. Sodium salts of these fixing agents are especially useful. These and other useful fixing agents are described in U.S. patent application Ser. No. 747,895 by Schmittou et al filed Aug. 19, 1991 entitled "Color Photographic Recording Material Processing," the disclosures of which are incorporated by reference.

In some cases the bleaching and fixing baths are combined in a bleach/fix bath.

The following examples illustrate the practice of this invention. They are not intended to be exhaustive of all possible variations of the invention. Parts and percentages are by weight unless otherwise indicated.

Specific samples of High Aspect Ratio Tabular Grain Silver Halide Emulsions that can be employed to demonstrate the practice of this invention may be precipitated and sensitized according to the following procedures. Silver Halide emulsions useful in the practice of the invention are not, however, limited to those specific samples exemplified below.

Emulsion Precipitation and Sensitization Example 1

1. Starting kettle: 45° C., 16 g oxidized gelatin (limed ossein gelatin, treated with peroxide to oxidize all methionine groups), 28 g NaBr, 3990 g distilled water, 2 ml of Nalco-2341 antifoam (pBr=1.29).

2. Nucleation stage:

a. Single jet run @33 ml/min, 0.2164 N $AgNO_3$, for two minutes.

b. Continue single jet silver run; raise kettle temperature from 45° C. to 60° C. over 7.5 minutes.

c. Adjust kettle pH with 5 ml of concentrated $NH_4OH$ (14.8M) diluted to 200 ml with distilled water. Continue single jet silver run throughout this segment for 5 minutes.

d. Stop silver run. Adjust kettle pH to starting value with 3.5 ml of concentrated $HNO_3$, diluted to 200 ml with distilled water. Hold for 2 minutes.

e. Add to kettle: 200 g of oxidized gelatin dissolved in 3991 g distilled water at 60° C. Hold 5 minutes.

3. Lateral growth:

Double jet with pBr controlled at 1.82, using 3.0N $AgNO_3$ and a salt solution which is 2.991M NaBr and 0.033M KI; following to the flow rate profile below:

| | |
|---|---|
| 10 minutes | 20 ml/min |
| 10 minutes | 20 to 47 ml/min |
| 10 minutes | 47 to 87 ml/min |
| 11.1 minutes | 87 to 145.9 ml/min |

4. Add to kettle a 292.5 g NaBr and 9.55 g KI dissolved in 535.5 g of distilled water. Hold 2 minutes.

5. Add to kettle 14.3 ml of a solution containing 0.17 mg/ml potassium selenocyanate, diluted to 150 ml with distilled water. Hold 2 minutes.

6. Add 0.316 mole of AgI Lippmann emulsion to kettle. Hold 2 minutes.

7. Single jet silver run with 3N $AgNO_3$ at 100 ml/min for 10.3 minutes. Reduce silver addition rate to 10 ml/min until kettle pBr reaches 2.50.

8. Wash emulsion to pBr=3.40 at 40° C. using ultrafiltration, concentrate, add 226 gm of limed ossein gelatin, 80 ml of solution containing 0.34 mg/ml 4-chloro-3,5-xylenol in methanol, chill set, and store.

The resulting emulsion is 4.1 mole % I.

This formula can be used to prepare emulsions typically 0.07 to 0.10 microns thick. Variations which can be made to this formula include changes in nucleation flowrate, the volume and gel concentration in the dump following the precipitation, and lateral growth pBr. The formula may also be scaled-up to produce larger quantities.

Green light spectral sensitizations (per mole of silver):

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.

b. Add 150 mg NaSCN. Hold 20 minutes with stirring c. Add green light spectral sensitizing dyes at 1.4 mmole dye/mole Ag. Higher or lower mole ratios may be employed in specific sensitizations. Single sensitizing dye or multiple sensitizing dye sensitizations may be employed as known in the art. When multiple dye sensitizations are employed, the dyes may be added together or may be added separately with an optional hold time between additions.

d. Add 3.00 mg of sodium thiosulfate pentahydrate. Hold 2 minutes.

e. Add 1.5 mg of potassium tetrachloroaurate(III). Hold 2 minutes.

f. Add 36.50 mg finish modifier (3-(N-methylsulfonyl)carbamoylethyl benzothiazolium tetrafluoroborate). Hold 15 minutes.

g. Raise melt temperature from 40° to 60° C. over 15 minutes. Hold at 65 degrees for 20 minutes. Cool rapidly to 40 degrees and chill set with stirring.

Red light spectral sensitization (per mole of silver)

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.

b. Add 120 mg NaSCN. Hold 20 minutes with stirring.

c. Add red light spectral sensitizing dyes at 1.3 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.

d. Add 2.50 mg of sodium thiosulfate pentahydrate. Hold 2 minutes.

e. Add 1.25 mg of potassium tetrachloroaurate(III). Hold 2 minutes.

f. Add 20.0 mg finish modifier (3-(N-methylsulfonyl)-carbamoylethyl benzothiazolium tetrafluoroborate). Hold 15 minutes.

g. Raise melt temperature from 40 to 60 degrees over 12 minutes. Hold at 60 degrees for 25 minutes. Cool rapidly to 40 degrees and chill set with stirring.

Emulsion Precipitation and Sensitization Example 2A

The preparation of thickened emulsions can be based on the formula given in Emulsion Precipitation and Sensitization Example 1 above. In this example the emulsion sample is precipitated as in Example 1 with the following changes:

The starting kettle temperature is 55° C. and the temperature ramp during step 2a is from 55° to 70° C. The remainder of the make is at 70° C. Limed ossein gelatin was used in place of the oxidized gel in step 2e. The pBr for the lateral growth step was 1.96 at 70° C. The resulting emulsion was 1.90 microns equivalent circular diameter and 0.139 microns thick.

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.

b. Add 100 mg NaSCN. Hold 20 minutes with stirring.

c. Add red light spectral sensitizing dyes at 0.9 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.

d. Add 2.00 mg of sodium thiosulfate pentahydrate. Hold 2 minutes.

e. Add 1.00 mg of potassium tetrachloroaurate(III). Hold 2 minutes.

f. Add 20.0 mg finish modifier (3-(N-methylsulfonyl)-carbamoylethyl benzothiazolium tetrafluoroborate). Hold 15 minutes.

g. Raise melt temperature from 40 to 62.5 degrees over 13.5 minutes. Hold at 62.5 degrees for 12 minutes. Cool rapidly to 40 degrees and chill set with stirring.

Emulsion Precipitation and Sensitization Example 2B

In another example the emulsion sample is precipitated as in Example 1 with the following changes:

The starting kettle temperature is 50° C. and the temperature ramp during step 2a is from 50° to 65° C. The remainder of the make is at 65° C. Limed ossein gelatin was used in place of the oxidized gel in step 2e. The pBr for the lateral growth step was 2.02 at 65° C. The resulting emulsion was 1.7 microns equivalent circular diameter and 0.145 microns thick.

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 12.5% gelatin solution (use limed ossein gelatin) to bring gel content to 78 g/mole silver.

b. Add 150 mg NaSCN. Hold 20 minutes with stirring.

c. Add green light spectral sensitizing dyes at 0.85 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.

d. Add 3.00 mg of sodium thiosulfate pentahydrate. Hold 2 minutes.

e. Add 1.50 mg of potassium tetrachloroaurate(III). Hold 2 minutes.

f. Add 40.0 mg finish modifier (3-(N-methylsulfonyl)-carbamoylethyl benzothiazolium tetrafluoroborate). Hold 15 minutes.

g. Raise melt temperature from 40 to 62.5 degrees over 13.5 minutes. Hold at 62.5 degrees for 22 minutes. Cool rapidly to 40 degrees and chill set with stirring.

Emulsion Precipitation and Sensitization Example 3

1. Starting kettle: 60° C., 25.0 g limed ossein gel, 55.0 g NaBr, 4872 g distilled water, 2 ml of Nalco-2341 Anti-foam.

2. Nucleation stage:

a. Double-jet nucleation with 2.5M $AgNO_3$ solution and 2.71M NaBr solution, both at 30 ml/min for three minutes. This is followed by a two-minute hold.

b. Adjust kettle pH with 35 ml of concentrated $NH_4OH$ (14.8M) diluted with 65 ml distilled water. Hold for 4 minutes.

c. Adjust pH back to starting value with HNO3. One minute hold.

d. Add to kettle 140 g limed ossein gelatin and 3866 g distilled water, melted together at 60° C. Hold two minutes.

3. Lateral growth: Double jet with pBr control at pBr=1.39 at 60° C., using 2.5N $AgNO_3$ solution, and a salt solution which is 2.46M NaBr and 0.04M KI. Use a ramped flow rate profile, from 10 to 85 ml/min over 53.3 minutes. Stop the silver and salt flow, hold for 30 seconds.

4. pBr adjust segment: over 10 minutes, run 2.5N $AgNO_3$ at 40 ml/min, allowing the kettle pBr to shift to 3.26. When pBr=3.26 is reached, control at 3.26 with a 2.5M NaBr solution.

5. Add 10 ml of solution containing 0.17 mg/ml potassium selenocyanate, diluted to 100 ml with distilled water. Hold 30 seconds.

6. Add 0.3 moles of KI dissolved in distilled water to 250 ml.

7. For 35 minutes, run 2.5N $AgNO_3$ at 40 ml/min. Allow the kettle pBr to shift to 3.26, then control at pBr 3.26 with 2.5M NaBr solution.

8. Wash emulsion to pBr=3.11 using ultrafiltration, concentrate, add 260 grams of limed ossein gel, 80 ml of solution containing 0.34 mg/ml of 4-chloro-3,5-xylenol in methanol, chill set, and store.

The resulting emulsion was 1.7 microns equivalent circular diameter and 0.15 microns thick, with 3.6% iodide.

This procedure is representative of the green light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40 C.

b. Add 100 mg NaSCN. Hold 20 minutes with stirring.

c. Add green light spectral sensitizing dyes at 0.9 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.

d. Add 40.0 mg finish modifier (3-(N-methylsulfonyl)carbamoylethyl benzothiazolium tetrafluoroborate). Hold 15 minutes.

e. Adjust melt pBr to 3.40 with dilute $AgNO_3$.

f. Add 1.50 mg of potassium tetrachloroaurate(III). Hold 2 minutes.

g. Add 3.00 mg of sodium thiosulfate pentahydrate. Hold 2 minutes.

g. Raise melt temperature from 40 to 65.0 degrees over 15.0 minutes. Hold at 65.0 degrees for 8 minutes. Cool rapidly to 40 degrees and chill set with stirring.

Emulsion Precipitation and Sensitization Example 4

1. Starting kettle: 65° C., total volume of 4.0 liters, with 5.0 g/L limed ossein gelatin and 11.0 g/L NaBr. No anti-foam was used.

2 Nucleation stage:

a. Double-jet nucleation using 1.00M $AgNO_3$ and 1.2M NaBr solutions, both at 82 ml/min. This is followed by a two-minute hold.

b. Adjust kettle pH with 25 ml of concentrated $NH_4OH$ (14.8M) diluted with 76 ml of distilled water. Hold for 4 minutes.

c. Adjust pH back to starting value with $HNO_3$. One minute hold.

d. Add to kettle a 5-L solution containing 140 g of limed ossein gelatin at 65° C. Hold 2 minutes.

3. Lateral growth: Double jet with pBr control at 1.55 at 65° C., using 2.5M $AgNO_3$, and a salt solution which is 2.46M NaBr and 0.04M KI. Use a ramped flow rate profile, from 8 to 82 ml/min over 53.5 minutes.

4. pBr adjust segment: over 10 minutes, run 2.5N $AgNO_3$ at 40 ml/min, allowing the kettle pBr to reach 3.20. When pBr 3.20 is reached, control pBr at 3.20 with a 2.5M NaBr solution.

5. Add 0.3 moles of KI dissolved in distilled water to 200 ml.

6. For 5 minutes, run 2.5N $AgNO_3$ at 40 ml/min, allowing the kettle pBr to shift to 3.20, then control at pBr=3.20 with 2.5M NaBr solution.

7. Continue double jet silver and salt for 20 minutes, except using a 2.5M NaBr solution which contains 100 mg $Na_3Fe(CN)_6$.

8. Continue double jet silver and salt for 10 minutes, using 2.5M NaBr.

9. After lowering the temperature to 50° C., add 2.5M NaBr to the kettle to adjust the pBr to 2.62. Wash the emulsion to pBr=3.25 using ultrafiltration, concentrate, add 260 g of limed ossein gel, 80 ml of solution containing 0.34 mg/ml of 4-chloro-3,5-xylenol in methanol, chill set and store.

The resulting emulsion was 1.9 microns equivalent circular diameter and 0.143 microns thick, with 3.6% iodide.

This procedure is representative of the red light spectral sensitizations on this emulsion type. Variations in sensitizing dye, thiocyanate, finish modifier, chemical sensitizers, and in finish time may be used as known in the art to reach an optimum finish position for a particular emulsion.

a. Melt emulsion at 40° C. Add 256 g of 35.0% gelatin solution (use limed ossein gelatin) to bring gel content to 77 g/mole silver.

b. Add 150 mg NaSCN. Hold 20 minutes with stirring.

c. Add red light spectral sensitizing dyes at 1.0 mmole dye/mole Ag. Higher or lower mole ratios may be employed in specific sensitizations. Single sensitizing dye or multiple sensitizing dye sensitizations may be employed as known in the art. When multiple dye sensitizations are employed the dyes may be added together or may be added separately with an optional hold time between additions.

d. Add 3.50 mg of sodium thiosulfate pentahydrate. Hold 2 minutes.

e. Add 1.75 mg of potassium tetrachloroaurate(III). Hold 2 minutes.

f. Add 40.0 mg of finish modifier (3-(N-methylsulfonyl)-carbamoylethyl benzothiazolium tetrafluoroborate). Hold 15 minutes.

g. Raise melt temperature from 40 to 65.0 degrees over 15.0 minutes. Hold at 65.0 degrees for 5 minutes. Cool rapidly to 40 degrees and chill set with stirring. Add additional heat to the emulsion by melting at 40° C., increase melt temperature from 40° to 65° C. over 15 minutes, hold for 15 minutes, and chill set with stirring.

Photographic Example 1

A color photographic recording material (Photographic Sample 101) for color negative development was prepared by applying the following layers in the given sequence to a transparent support of cellulose triacetate. The quantities of silver halide are given in g of silver per $m^2$. The quantities of other materials are given in g per $m^2$. All silver halide emulsions were stabilized with 2 grams of 4-hydroxy-6-methyl-1,3,3a,7-tetraazaindene per mole of silver.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.6 microns, average grain thickness 0.09 micron] at 0.54 g, red sensitized silver iodobromide emulsion [4.2 mol % iodide, average grain diameter 1.7 microns, average grain thickness 0.08 micron] at 0.43 g, cyan dye-forming image coupler C-1 at 0.54 g, DIR compound D-1 at 0.017 g, BAR compound B-1 at 0.016 g, with gelatin at 1.61 g.

Layer 3 {Second (more) Red-Sensitive Layer} Red sensitized silver iodobromide emulsion [4.2 mol % iodide, average grain diameter 2.1 microns, average grain thickness 0.09 microns] at 1.13 g, cyan dye-forming image coupler C-2 at 0.23 g, DIR compound D-1 at 0.023 g, BAR compound B-1 at 0.005 g, cyan dye-forming masking coupler CM-1 at 0.032 g with gelatin at 1.61 g.

Layer 4 {(Interlayer} Oxidized developer scavenger S-1 at 0.054 g, yellow dye material YD-1 at 0.12 g and 1.29 g of gelatin.

Layer 5 {First (less) Green-Sensitive Layer} Green sensitized silver iodobromide emulsion [3.9 mol % iodide, average grain diameter 0.6 microns, average thickness 0.09 microns] at 0.43 g, green sensitized silver iodobromide emulsion [4 mol % iodide, average grain diameter 1.1 microns, average thickness 0.12 microns] at 0.65 g, magenta dye-forming image coupler M-1 at 0.022 g, magenta dye-forming image coupler M-2 at 0.51 g, DIR compound D-2 at 0.007 g, DIR compound D-3 at 0.022 g magenta dye-forming masking coupler MM-1 at 0.043 g with gelatin at 1.88 g.

Layer 6 {Second (more) Green-Sensitive Layer} Green sensitized silver iodobromide emulsion [4.2 mol % iodide, average grain diameter 2 microns, average grain thickness 0.08 microns] at 1.08 g, magenta dye-forming image coupler M-1 at 0.043 g, magenta dye-forming image coupler M-2 at 0.13 g, magenta dye-forming masking coupler MM-1 at 0.022 g, DIR compound D-2 at 0.007 g, DIR compound D-3 at 0.008 g with gelatin at 1.08 g.

Layer 7 {Interlayer} Oxidized developer scavenger S-1 at 0.054 g, yellow colloidal silver at 0.032 g with 1.61 g of gelatin.

Layer 8 {First (less) Blue-Sensitive Layer} Blue sensitized silver iodobromide emulsion [4 mol % iodide, average grain diameter 0.1 microns, average grain thickness 0.09 micron] at 0.32 g, blue sensitized silver iodobromide emulsion [4 mol % iodide, average grain diameter 1.3 microns, average grain thickness 0.09 micron] at 0.16 g, yellow dye-forming image coupler Y-1 at 0.91 g, DIR compound D-4 at 0.04 g, BAR compound B-2 at 0.016 g with gelatin at 1.61 g.

Layer 9 {Second (more) Blue-Sensitive Layer} Blue sensitized silver iodobromide emulsion [3 mol % iodide, average grain diameter 2.6 microns, average grain thickness 0.12 microns] at 0.75 g, yellow dye-forming image coupler Y-1 at 0.22 g, DIR compound D-4 at 0.039 g, with gelatin at 1.21 g.

Layer 10 {Protective Layer} 0.108 g of dye UV-1, 0.118 g of dye UV-2, unsensitized silver bromide Lippman emulsion at 0.108 g, with gelatin at 0.89 g.

This film was hardened at coating with 2% by weight to total gelatin of hardner H-1. Surfactants, coating aids, scavengers, soluble absorber dyes and stabilizers were added to the various layers of this sample as is commonly practiced in the art.

Photographic Sample 102 was prepared like Photographic Sample 101 except that 0.02 g of ballasted red absorber dye CD-1 was added to layer 10.

Photographic Sample 103 was prepared like Photographic Sample 101 except that the emulsion employed in layer 3 was replaced by an equal quantity of an emulsion with an average grain diameter of 1.9 microns and an average grain thickness of 0.14 microns.

Photographic Sample 104 was prepared like Photographic Sample 103 except that 0.02 g of ballasted red absorber dye CD-1 was added to layer 10.

Photographic Sample 105 was prepared like Photographic Sample 103 except that the emulsion employed in layer 6 was replaced by an equal quantity of an emulsion with an average grain diameter of 1.7 microns and an average grain thickness of 0.15 microns.

Photographic Sample 106 was prepared like Photographic Sample 105 except that 0.02 g of ballasted red absorber dye CD-1 was added to layer 10.

Photographic Sample 107 was prepared like Photographic Sample 101 except that the emulsion employed in layer 6 was replaced by an equal quantity of an emulsion with an average grain diameter of 1.7 microns and an average grain thickness of 0.15 microns.

Photographic Sample 108 was prepared like Photographic Sample 107 except that 0.02 g of ballasted red absorber dye CD-1 was added to layer 10.

C-1
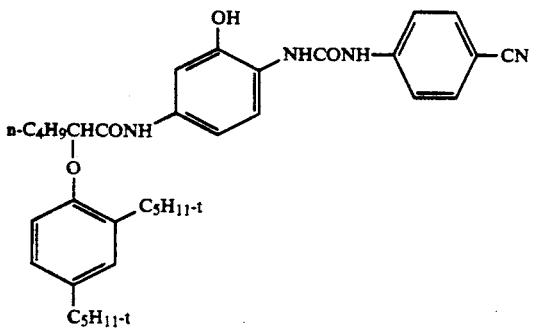
C-2
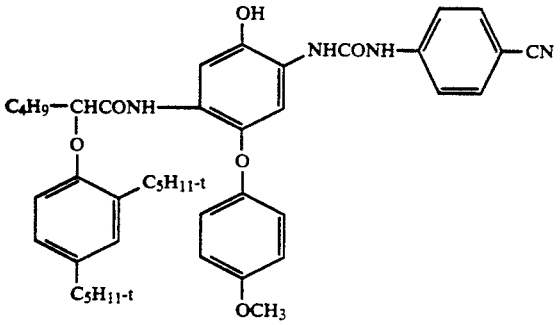
M-1
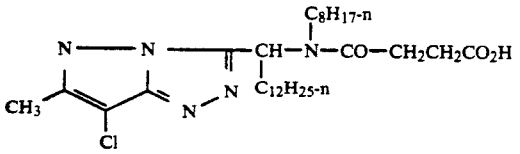
M-2
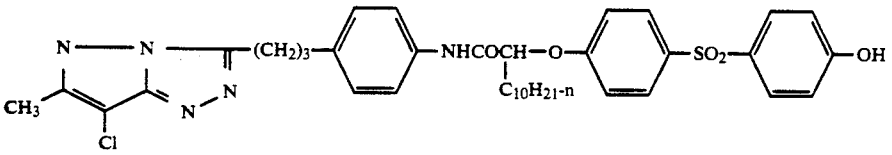
M-3
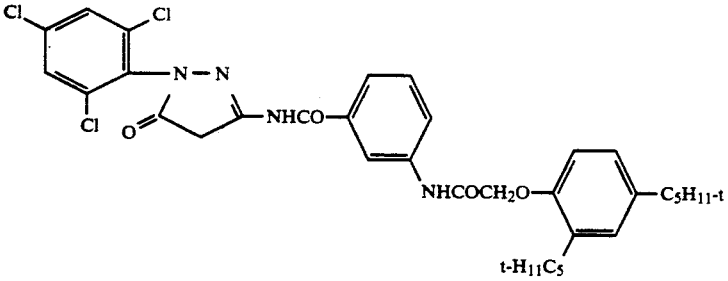
Y-1
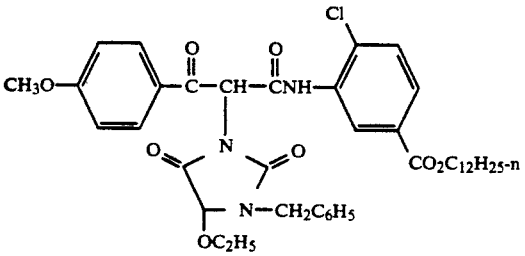

-continued
Y-2
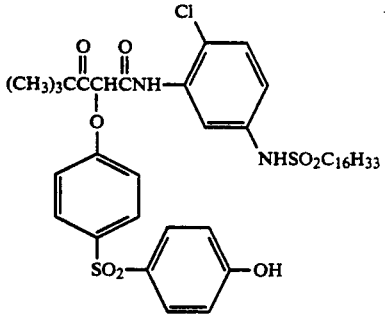
D-1
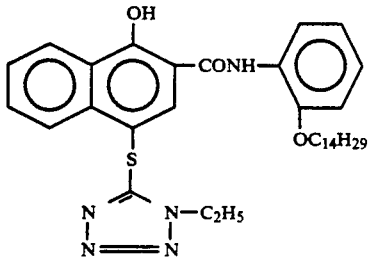
D-2
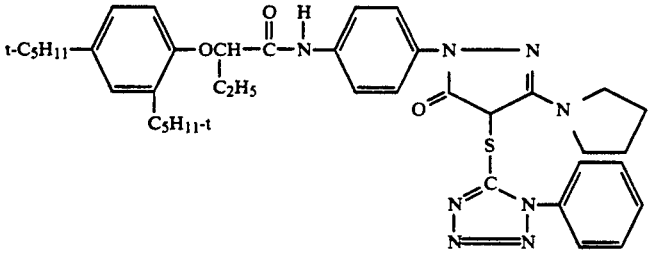
D-3
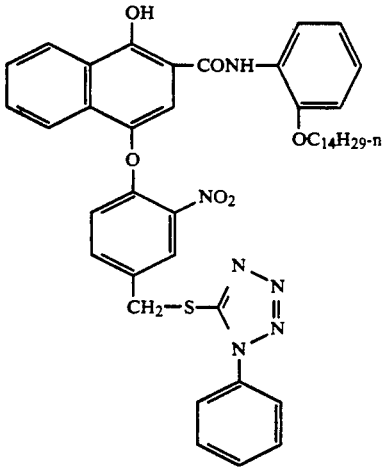
D-4
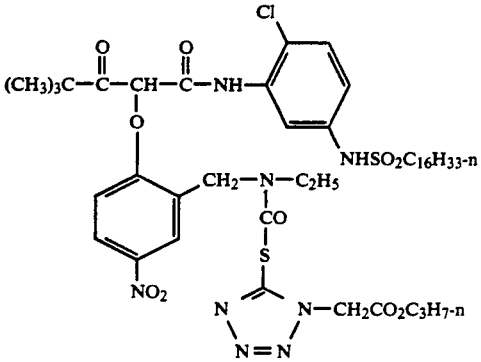

-continued
D-5
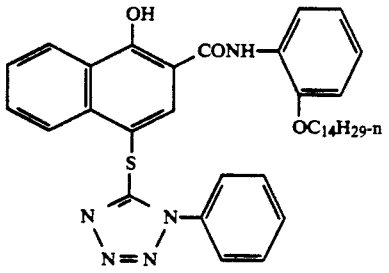
D-6
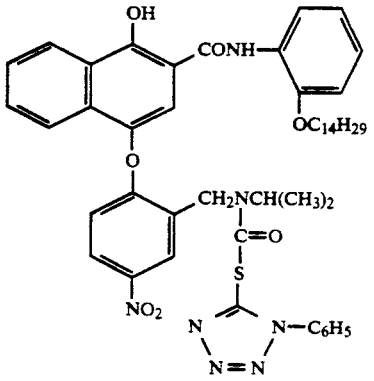
D-7
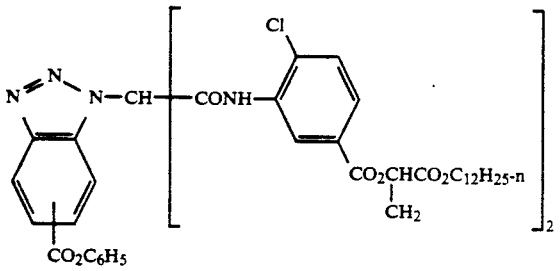
B-1
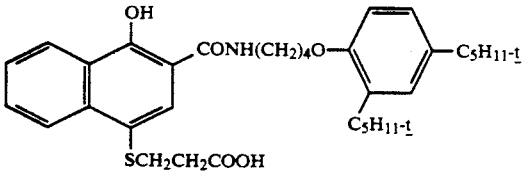
B-2
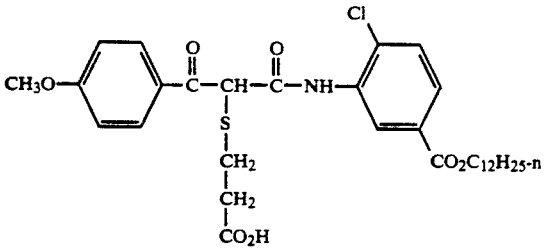
S-1
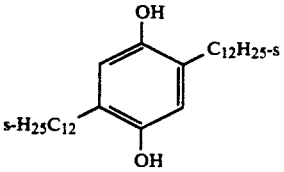

-continued

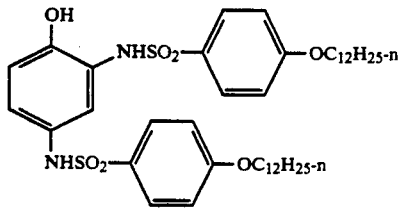

S-2

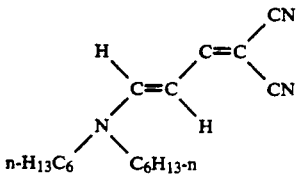

UV-1

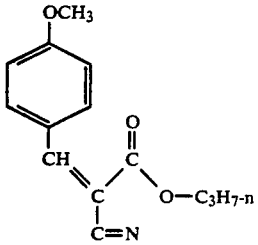

UV-2

$CH_2(SO_2CH{=}CH_2)_2$

H-1

Polymer Latex A: n-butyl acrylate/2-acrylamido-2-methylpropane sulfonic acid/2-acetoacetoxyethyl methacrylate (88:5:7) Tg = −28° C.

Polymer Latex C: Methyl acrylate/2-acrylamido-2-methylpropane sulfonic acid/2-acetoacetoxyethyl methacrylate (91:5:4) Tg = +10.5° C.

The Photographic Samples were exposed using white light to sinusoidal patterns to determine the Modulation Transfer Function (MTF) Percent Response as a function of spatial frequency in the film plane. Specific details of this exposure-evaluation cycle can be found at R. L. Lamberts and F. C. Eisen, "A System for the Automated Evaluation of Modulation Transfer Functions of Photographic Materials", in the *Journal of Applied Photographic Engineering*, vol. 6. pages 1-8, February 1980. A more general description of the determination and meaning of MTF Percent Response curves can be found in the articles cited within this reference. The exposed samples were developed and bleached generally according to the C-41 Process as described in the *British Journal of Photography Annular* for 1988 at pages 196-198. The bleaching solution was modified so as to comprise 1,3-propane diamine tetraacetic acid. The exposed and processed samples were evaluated to determine the MTF Percent Response as a function of spatial frequency in the film plane as described above.

Table 1 (below) lists the MTF Percent Response characteristics of the cyan dye images formed by the red light sensitive layers of the described photographic samples.

TABLE 1

MTF Percent Response of the Red Light Sensitive Layers as a Function of Film Formulation

| Sample[a] | Tabular Emulsion[b] (A) | Tabular Emulsion[b] (B) | Absorber[c] Dye | MTF Percent Response[d] 2.5 c/mm | 5 c/mm | 50 c/mm | 80 c/mm |
|---|---|---|---|---|---|---|---|
| 101 C | 2.0 × 0.08 | 2.1 × 0.09 | No | 99 | 96 | 34 | 19 |
| 103 I | 2.0 × 0.08 | 1.9 × 0.14 | No | 101 | 100 | 39 | 19 |
| 102 C | 2.0 × 0.08 | 2.1 × 0.09 | Yes | 103 | 101 | 36 | 19 |
| 104 I | 2.0 × 0.08 | 1.9 × 0.14 | Yes | 102 | 104 | 42 | 26 |
| 107 C | 1.7 × 0.15 | 2.1 × 0.09 | No | 99 | 100 | 36 | 19 |
| 105 I | 1.7 × 0.15 | 1.9 × 0.14 | No | 102 | 102 | 44 | 25 |
| 108 C | 1.7 × 0.15 | 2.1 × 0.09 | Yes | 101 | 101 | 41 | 21 |
| 106 I | 1.7 × 0.15 | 1.9 × 0.14 | Yes | 103 | 105 | 45 | 25 |

[a]Samples are identified as comparison (C), or inventive (I)

[b]Dimensions of tabular grain AgX emulsions as average equivalent circular diameter × thickness (both in microns) in the most green sensitive layer (A) and the most red sensitive layer (B).

[c]Presence of red light absorbing ballasted absorber dye positioned between the most red light sensitive layer and the source of the imaging exposure.

[d]MTF Percent Response at the indicated spatial frequency in the film plane for the cyan dye images formed in the red light sensitive layers.

As can be readily appreciated on examination of the data presented in Table 1, the photographic samples incorporating a tabular grain emulsion in the most light sensitive layer sensitized to a particular region of the spectrum where the thickness of the grain has been chosen so as to minimize light reflection in that wavelength range enables the highest MTF Percent Response within each sample pair that differ only in that characteristic (samples 101 & 103; 102 & 104; 107 & 105; and 108 & 106).

In this example, the thickness of the most light sensitive red light sensitive emulsion was chosen so as to minimize the reflectance of red light. These improvements in MTF Percent Response occur at both low and high spatial frequencies. In this example, the most red light sensitive layer is positioned further from the exposing image source than any other most light sensitive layer in the photographic material.

Additionally, the improvement in sharpness shown in the inventive samples vs their respective comparison samples occurs in the presence or absence of a ballasted absorber dye which absorbs light in the same region of the spectrum. In this case a red light absorbing ballasted absorber dye was employed.

Further, a surprisingly large improvement in sharpness occurs when the positioned ballasted absorber dye is present and the emulsion grain thickness has been chosen to minimize reflection is the region of the spectrum to which the emulsion is sensitized. Comparative examination of the photographic data supplied for samples 104 & 106 vs that for samples 101, 102, 103, 105, 107 & 108 serves to illustrate this demonstration.

Photographic Example 2

A color photographic recording material (Photographic Sample 201) for color negative development was prepared by applying the following layers in the given sequence to a transparent support of cellulose triacetate. The quantities of silver halide are given in g of silver per $m^2$. The quantities of other materials are given in g per $m^2$. All silver halide emulsions were stabilized with about 2 grams of 4-hydroxy-6-methyl-1,3,3a,7-tetraazaindene per mole of silver.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.43 g, red sensitized silver iodobromide emulsion [4.2 mol % iodide, average grain diameter 1.7 microns, average grain thickness 0.08 micron] at 0.54 g, cyan dye-forming image coupler C-1 at 0.65 g, DIR compound D-1 at 0.022 g, DIR compound D-3 at 0.002 g, cyan dye-forming masking coupler CM-1 at 0.022 g with gelatin at 1.61 g.

Layer 3 {Second (more) Red-Sensitive Layer} Red sensitized silver iodobromide emulsion [4.2 mol % iodide, average grain diameter 2.1 microns, average grain thickness 0.09 microns] at 1.18 g, cyan dye-forming image coupler C-2 at 0.23 g, DIR compound D-1 at 0.041 g, DIR compound D-5 at 0.008 g, BAR compound B-1 at 0.003 g, cyan dye-forming masking coupler CM-1 at 0.027 g, with gelatin at 1.61 g.

Layer 4 {Interlayer} Oxidized developer scavenger S-1 at 0.054 g, yellow dye material YD-1 at 0.12 g and 1.29 g of gelatin.

Layer 5 {First (less) Green-Sensitive Layer} Green sensitized silver iodobromide emulsion [3.9 mol % iodide, average grain diameter 0.75 microns, average thickness 0.1 microns] at 0.75 g, magenta dye-forming image coupler M-1 at 0.11 g, magenta dye-forming image coupler M-2 at 0.22 g, DIR compound D-2 at 0.004 g, DIR compound D-3 at 0.011 g, magenta dye-forming masking coupler MM-1 at 0.032 g, oxidized developer scavenger S-2 at 0.002 g, with gelatin at 1.29 g.

Layer 6 {Second (more) Green-Sensitive Layer} Green sensitized silver iodobromide emulsion [4 mol % iodide, average grain diameter 1.4 microns, average thickness 0.09 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.01 g, magenta dye-forming masking coupler MM-1 at 0.022 g, oxidized developer scavenger S-2 at 0.007 g, with gelatin at 1.88 g.

Layer 7 {Third (most) Green-Sensitive Layer} Green sensitized silver iodobromide emulsion [4 mol % iodide, average grain diameter 2.2 microns, average grain thickness 0.08 microns] at 0.97 g, magenta dye-forming image coupler M-1 at 0.043 g, magenta dye-forming image coupler M-2 at 0.048 g, magenta dye-forming masking coupler MM-1 at 0.032 g, DIR compound D-2 at 0.003 g, DIR compound D-3 at 0.007 g, oxidized developer scavenger S-2 at 0.008 g, BAR compound B-2 at 0.002 g, with gelatin at 1.51 g.

Layer 8 {Interlayer} Oxidized developer scavenger S-1 at 0.021 g, with 0.54 g of gelatin.

Layer 9 {Interlayer} Yellow dye YD-2 at 0.11 g with 1.08 g of gelatin.

Layer 10 {First (less) Blue-Sensitive Layer} Blue sensitized silver iodobromide emulsion [6 mol % iodide, average grain diameter 0.4 microns, average grain thickness 0.18 micron] at 0.16 g, blue sensitized silver iodobromide emulsion [6 mol % iodide, average grain diameter 1.1 microns, average grain thickness 0.36 micron] at 0.22 g, yellow dye-forming image coupler Y-1 at 0.86 g, DIR compound D-4 at 0.038 g with gelatin at 1.61 g.

Layer 11 {Second (more) Blue-Sensitive Layer} Blue sensitized silver iodobromide emulsion [6 mol % iodide, average grain diameter 2 microns, average grain thickness 0.35 microns] at 0.75 g, yellow dye-forming image coupler Y-1 at 0.22 g, DIR compound D-4 at 0.038 g, BAR compound B-1 at 0.005 g with gelatin at 1.21 g.

Layer 12 {Protective Layer} 0.108 g of dye UV-1, 0.118 g of dye UV-2, unsensitized silver bromide Lippman emulsion at 0.108 g, anti-matte polyacrylamide beads at 0.054 g, ballasted absorber dye CD-1 at 0.005 g, ballasted absorber dye MD-1 at 0.001 g with gelatin at 1.22 g.

This film was hardened at coating with 2% by weight to total gelatin of hardner H-1. Surfactants, coating aids, scavengers, film base antihalation dyes and stabilizers were optionally added to the various layers of this sample as is commonly practiced in the art.

Photographic Sample 202 was prepared like Photographic Sample 201 except that 0.032 g of soluble red light absorber dye SOL-C1 and 0.032 g of soluble green light absorber dye SOL-M1 were added at coating to layer 8. The soluble dye distribute throughout the coating structure during the coating preparation procedure.

Photographic Sample 203 was prepared like Photographic Sample 201 except that 0.064 g of soluble red light absorber dye SOL-C1 and 0.064 g of soluble green light absorber dye SOL-M1 were added at coating to layer 8. The soluble dye distribute throughout the coating structure during the coating preparation procedure.

Photographic Sample 204 was prepared like Photographic Sample 201 except that the emulsion in layer 3 was replaced by an equal weight of a red sensitized silver iodobromide emulsion [4.2 mol % iodide, average grain diameter 2.0 microns, average grain thickness 0.14 microns], and that the emulsion in layer 7 was replaced by an equal weight of a green sensitized silver iodobromide emulsion [4 mol % iodide, average grain diameter 1.7 microns, average grain thickness 0.15 microns].

Photographic Sample 205 was prepared like Photographic Sample 204 except that 0.064 g of soluble red light absorber dye SOL-C1 and 0.064 g of soluble green light absorber dye SOL-M1 were added at coating to layer 8. The soluble dye distribute throughout the coating structure during the coating preparation procedure.

Photographic Sample 408 was prepared in a manner analogous to that used to prepare Photographic Sample 201 by applying the following layers in the given sequence to a transparent support of cellulose triacetate.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.43 g, red sensitized silver iodobromide emulsion [4.2 mol % iodide, average grain diameter 1.7 microns, average grain thickness 0.08 micron] at 0.54 g, cyan dye-forming image coupler C-1 at 0.65 g, DIR compound D-1 at 0.032 g, cyan dye-forming masking coupler CM-1 at 0.011 g, BAR compound B-1 at 0.038 g with gelatin at 1.78 g.

Layer 3 {Second (more) Red-Sensitive Layer} Red sensitized silver iodobromide emulsion [4 mol % iodide, average grain diameter 2 microns, average grain thickness 0.14 microns] at 1.18 g, cyan dye-forming image coupler C-2 at 0.23 g, DIR compound D-1 at 0.043 g, DIR compound D-5 at 0.004 g, BAR compound B-1 at 0.003 g, cyan dye-forming masking coupler CM-1 at 0.027 g, with gelatin at 1.66 g.

Layer 4 {Interlayer} Oxidized developer scavenger S-1 at 0.054 g, yellow dye material YD-1 at 0.086 g and 1.29 g of gelatin.

Layer 5 {First (less) Green-Sensitive Layer} Green sensitized silver iodobromide emulsion [3.9 mol % iodide, average grain diameter 0.75 microns, average thickness 0.1 microns] at 0.75 g, magenta dye-forming image coupler M-1 at 0.11 g, magenta dye-forming image coupler M-2 at 0.22 g, DIR compound D-2 at 0.002 g, DIR compound D-3 at 0.011 g, magenta dye-forming masking coupler MM-1 at 0.032 g, oxidized developer scavenger S-2 at 0.002 g, with gelatin at 1.29 g.

Layer 6 {Second (more) Green-Sensitive Layer} Green sensitized silver iodobromide emulsion [4 mol % iodide, average grain diameter 1.1 microns, average thickness 0.12 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.01 g, magenta dye-forming masking coupler MM-1 at 0.022 g, oxidized developer scavenger S-2 at 0.007 g, with gelatin at 1.51 g.

Layer 7 {Third (most) Green-Sensitive Layer} Green sensitized silver iodobromide emulsion [4 mol % iodide, average grain diameter 1.7 microns, average grain thickness 0.15 microns] at 0.97 g, magenta dye-forming image coupler M-1 at 0.043 g, magenta dye-forming image coupler M-2 at 0.048 g, magenta dye-forming masking coupler MM-1 at 0.032 g, DIR compound D-2 at 0.002 g, DIR compound D-3 at 0.007 g, oxidized developer scavenger S-2 at 0.005 g, BAR compound B-2 at 0.002 g, with gelatin at 1.51 g.

Layer 8 {Interlayer} Oxidized developer scavenger S-1 at 0.021 g, with 0.54 g of gelatin.

Layer 9 {Interlayer} Yellow dye YD-2 at 0.11 g with 1.08 g of gelatin.

Layer 10 {First (less) Blue-Sensitive Layer} Blue sensitized silver iodobromide emulsion [4 mol % iodide, average grain diameter 0.9 microns, average grain thickness 0.09 micron] at 0.16 g, blue sensitized silver iodobromide emulsion [4 mol % iodide, average grain diameter 1.5 microns, average grain thickness 0.09 micron] at 0.22 g, yellow dye-forming image coupler Y-1 at 0.86 g, DIR compound D-4 at 0.038 g with gelatin at 1.61 g.

Layer 11 {Second (more) Blue-Sensitive Layer} Blue sensitized silver iodobromide emulsion [3 mol % iodide, average grain diameter 3.3 microns, average grain thickness 0.12 microns] at 0.70 g, yellow dye-forming image coupler Y-1 at 0.22 g, DIR compound D-4 at 0.038 g, BAR compound B-1 at 0.005 g with gelatin at 1.21 g.

Layer 12 {Protective Layer} 0.108 g of dye UV-1, 0.118 g of dye UV-2, unsensitized silver bromide Lippman emulsion at 0.108 g, anti-matte polyacrylamide beads at 0.054 g, with gelatin at 1.22 g.

Photographic Sample 409 was prepared like Photographic Sample 408 except that 0.036 g of soluble red light absorber dye SOL-C1 and 0.054 g of soluble green light absorber dye SOL-M1 were added at coating to layer 8. The soluble dye distribute throughout the coating structure during the coating preparation procedure.

Photographic Sample 410 was prepared like Photographic Sample 409 except that the tabular grain emulsion in layer 3 was replaced by an equal quantity of a red sensitized silver iodobromide emulsion [4.2 mol % iodide, average grain diameter 2.1 microns, average grain thickness 0.09 microns].

Photographic Sample 411 was prepared like Photographic Sample 410 except that the soluble absorber dyes SOL-C1 and SOL-M1 were omitted from layer 8 and the tabular grain silver halide emulsions in layer 6 and layer 7 were replaced by an equal weight of a green sensitized silver iodobromide emulsion [4 mol % iodide, average grain diameter 1.4 microns, average grain thickness 0.09 microns] in layer 6 and an equal weight of a green sensitized silver iodobromide emulsion [4 mol % iodide, average grain diameter 2.3 microns, average grain thickness 0.09 microns] in layer 7.

Photographic Sample 412 was prepared like Photographic Sample 411 except that 0.036 g of soluble red light absorber dye SOL-C1 and 0.054 g of soluble green light absorber dye SOL-M1 were added at coating to layer 8. The soluble dye distribute throughout the coating structure during the coating preparation procedure.

Photographic Sample 413 was prepared like Photographic Sample 412 except that the tabular grain emulsion in layer 3 was replaced by an equal quantity of a red sensitized silver iodobromide emulsion [4 mol % iodide, average grain diameter 2 microns, average grain thickness 0.14 microns].

Photographic Sample 514 was prepared in a manner analogous to that used to prepare Photographic Sample 408 by applying the following layers in the given sequence to a transparent support of cellulose triacetate.

Layer 1 {Antihalation Layer} black colloidal silver sol containing 0.236 g of silver, with 2.44 g gelatin.

Layer 2 {First (less) Red-Sensitive Layer} Red sensitized silver iodobromide emulsion [3.9 mol % iodide, average grain diameter 0.65 microns, average grain thickness 0.09 micron] at 0.75 g, cyan dye-forming image coupler C-1 at 0.43 g, DIR compound D-1 at 0.022 g, cyan dye-forming masking coupler CM-1 at 0.027 g, with gelatin at 1.5 g.

Layer 3 {Second (more) Red-Sensitive Layer} Red sensitized silver iodobromide emulsion [4.2 mol % iodide, average grain diameter 1.6 microns, average grain thickness 0.10 micron] at 0.97 g, cyan dye-forming image coupler C-2 at 0.16 g, DIR compound D-1 at 0.022 g, DIR coupler D-5 at 0.005 g, cyan dye-forming masking coupler CM-1 at 0.022 g, with gelatin at 1.51 g.

Layer 4 {Third (most) Red-Sensitive Layer} Red sensitized silver iodobromide emulsion [4 mol % iodide, average grain diameter 2.1 microns, average grain thickness 0.09 microns] at 0.97 g, cyan dye-forming image coupler C-2 at 0.15 g, DIR compound D-1 at 0.027 g, DIR compound D-5 at 0.005 g, cyan dye-forming masking coupler CM-1 at 0.016 g, with gelatin at 1.4 g.

Layer 5 {Interlayer} Oxidized developer scavenger S-1 at 0.16 g, yellow dye material YD-1 at 0.13 g and 0.65 g of gelatin.

Layer 6 {First (less) Green-Sensitive Layer} Green sensitized silver iodobromide emulsion [3.9 mol % iodide, average grain diameter 0.65 microns, average thickness 0.09 microns] at 0.75 g, magenta dye-forming image coupler M-1 at 0.11 g, magenta dye-forming image coupler M-2 at 0.22 g, DIR compound D-2 at 0.004 g, DIR compound D-3 at 0.011 g, magenta dye-forming masking coupler MM-1 at 0.037 g, with gelatin at 1.51 g.

Layer 7 {Second (more) Green-Sensitive Layer} Green sensitized silver iodobromide emulsion [4 mol % iodide, average grain diameter 1.4 microns, average thickness 0.09 microns] at 0.97 g, magenta dye-forming image coupler M-1 at 0.054 g, magenta dye-forming image coupler M-2 at 0.054 g, DIR compound D-2 at 0.008 g, DIR compound D-3 at 0.011 g, magenta dye-forming masking coupler MM-1 at 0.023 g, with gelatin at 0.97 g.

Layer 8 {Third (most) Green-Sensitive Layer} Green sensitized silver iodobromide emulsion [4 mol % iodide, average grain diameter 2.3 microns, average grain thickness 0.09 microns] at 0.97 g, magenta dye-forming image coupler M-1 at 0.038 g, magenta dye-forming image coupler M-2 at 0.038 g, magenta dye-forming masking coupler MM-1 at 0.016 g, DIR compound D-2 at 0.005 g, DIR compound D-3 at 0.008 g, with gelatin at 1.29 g.

Layer 9 {Interlayer} Oxidized developer scavenger S-1 at 0.16 g, with 0.65 g of gelatin.

Layer 10 {Interlayer} Yellow colloidal silver at 0.038 g, oxidized developer scavenger S-1 at 0.038 g with 0.65 g of gelatin.

Layer 11 {First (less) Blue-Sensitive Layer} Blue sensitized silver iodobromide emulsion [4 mol % iodide, average grain diameter 0.9 microns, average grain thickness 0.09 micron] at 0.33 g, blue sensitized silver iodobromide emulsion [4 mol % iodide, average grain diameter 1.5 microns, average grain thickness 0.09 micron] at 0.22 g, yellow dye-forming image coupler Y-1 at 0.86 g, DIR compound D-4 at 0.033 g, BAR compound B-2 at 0.022 g with gelatin at 2.36 g.

Layer 12 {Second (more) Blue-Sensitive Layer} Blue sensitized silver iodobromide emulsion [3 mol % iodide, average grain diameter 3.3 microns, average grain thickness 0.12 microns] at 0.76 g, yellow dye-forming image coupler Y-1 at 0.22 g, DIR compound D-4 at 0.033 g, with gelatin at 1.72 g.

Layer 13 {Protective Layer} 0.108 g of dye UV-1, 0.118 g of dye UV-2, unsensitized silver bromide Lippman emulsion at 0.108 g, 1.08 g of Polymer latex A; 0.22 g of Polymer latex C, with gelatin at 1.08 g.

Layer 14 {Protective Layer} Anti-matte polyacrylamide beads at 0.054 g, dye CD-1 at 0.008 g with gelatin at 0.75 g.

Photographic Sample 515 was prepared like Photographic Sample 514 except that 0.0037 g of soluble red light absorber dye SOL-C1 and 0.0043 g of soluble green light absorber dye SOL-M1 were added at coating to layer 13. The soluble dye distribute throughout the coating structure during the coating preparation procedure.

Photographic Sample 516 was prepared like Photographic Sample 515 except that the tabular grain emulsions in layers 4 was replaced by an equal weight of a red sensitized silver iodobromide emulsion [4 mol % iodide, average grain diameter 2.0 microns, average grain thickness 0.14 microns] and the tabular grain emulsion in layer 8 was replaced by an equal weight of a green sensitized silver iodobromide emulsion [4 mol % iodide, average grain diameter 1.7 microns, average grain thickness 0.15 microns].

Photographic Sample 517 was prepared like Photographic Sample 516 except that soluble dyes SOL-C1 and SOL-ml were omitted from layer 13.

The Photographic Samples were exposed using white light to sinusoidal patterns to determine the Modulation Transfer Function (MTF) Percent Response as a function of spatial frequency in the film plane. Specific details of this exposure - evaluation cycle can be found at R. L. Lamberts and F. C. Eisen, "A System for the Automated Evaluation of Modulation Transfer Functions of Photographic Materials", in the *Journal of Applied Photographic Engineering*, Vol. 6, pages 1-8, February 1980. A more general description of the determination and meaning of MTF Percent Response curves can be found in the articles cited within this reference. The exposed samples were developed according to the C-41 Process as described in the *British Journal of Photography Annual* for 1988 at pages 196-198. The composition of the bleaching solution was modified to comprise 1,3-propylene diamine to tetraacetic acid. The exposed and processed samples were evaluated to determine the MTF Percent Response as a function of spatial frequency in the film plane as described above.

The samples were additionally exposed to white light through a graduated density test object and developed according to the C-41 Process as described above. The speed of each color record was ascertained by measuring the Status M density of the dye deposits formed as a function of exposure and determining the exposure required to enable production of a dye density of 0.15 above fog. This exposure value is inversely related to the speed of the color record in the photographic sample. Incorporation of quantities of distributed absorber dye cause an increase in the quantity of exposure required to enable production of the desired density. This increase in required exposure corresponds to a speed loss. The percentage of speed in the presence of absorber dye relative to the speed in the absence of absorber dye calculated as:

$$\frac{\text{Required exposure in absence of distributed dye}}{\text{Required exposure in presence of distributed dye}} \times 100$$

Table 2 (below) lists the MTF Percent Response characteristics of the cyan dye images formed by the red light sensitive layers of the described photographic samples.

These samples showed a dry film thickness of 20.4 microns as measured from the photosensitive layer that is farthest form the support to the photosensitive layer that is nearest the support.

TABLE 2

MTF Percent Response of the Red Light Sensitive Layers as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 103 | 100 | 24 | 11 |
| 204 I | 1.7 × 0.15 | 2.0 × 0.14 | No (100%) | 105 | 105 | 27 | 12 |
| 202 C | 2.2 × 0.08 | 2.1 × 0.09 | Yes (58%) | 106 | 107 | 28 | 13 |
| 203 C | 2.2 × 0.08 | 2.1 × 0.09 | Yes (32%) | 106 | 107 | 33 | 16 |
| 205 I | 1.7 × 0.15 | 2.0 × 0.14 | Yes (35%) | 107 | 111 | 40 | 18 |
| 411 C | 2.3 × 0.09 | 2.1 × 0.09 | No (100%) | 99 | 91 | 29 | 21 |
| 408 I | 1.7 × 0.15 | 2.0 × 0.14 | No (100%) | 100 | 96 | 39 | 23 |
| 410 C | 1.7 × 0.15 | 2.1 × 0.09 | Yes (56%) | 104 | 103 | 48 | 26 |
| 409 I | 1.7 × 0.15 | 2.0 × 0.14 | Yes (56%) | 105 | 106 | 52 | 28 |
| 412 C | 2.3 × 0.09 | 2.1 × 0.09 | Yes (41%) | 102 | 102 | 47 | 26 |
| 413 I | 2.3 × 0.09 | 2.0 × 0.14 | Yes (42%) | 104 | 107 | 48 | 28 |
| 514 C | 2.3 × 0.09 | 2.1 × 0.09 | No (100%) | 105 | 98 | 34 | 18 |
| 517 I | 1.7 × 0.15 | 2.0 × 0.14 | No (100%) | 106 | 102 | 40 | 19 |
| 515 C | 2.3 × 0.09 | 2.1 × 0.09 | Yes (95%) | 104 | 97 | 33 | 18 |
| 516 I | 1.7 × 0.15 | 2.0 × 0.14 | Yes (93%) | 106 | 100 | 36 | 19 |

[a]Samples are identified as comparison (C), or inventive (I).

[b]Dimensions of tabular grain AgX emulsions as a average equivalent circular diameter × thickness (both in microns) in the most green sensitive layer (A) and the most red sensitive layer (B).

[c]Presence of red light absorbing distributed absorber dye within the film structure. Speed loss induced in the red light sensitive element by presence of the distributed dye is shown in parenthesis and expressed as a percent of the speed of the control element not incorporating the distributed dye. Samples 201-205 and 514-517 additionally incorporate a spatially fixed red light absorbing dye positioned between the most red sensitive layer and the exposing light source. In s ample 204 this additional dye causes the speed to be 93% of that of an otherwise identical sample prepared without the spatially fixed dye. In sample 514 this additional dye causes the speed to be 90% of that of an otherwise identical sample.

[d]MTF Percent Response at the indicated spatial frequency in the film plane for the cyan dye images formed in the red light sensitive layers.

As can be readily appreciated on examination of the photographic data presented in Table 2, the photographic samples incorporating a tabular grain emulsion in the most light sensitive layer of the red light sensitive element, where the most red light sensitive layer is located furthest from the image exposure source of all of the most light sensitive layers and where the tabular grain silver halide emulsion grain thickness of the red sensitized emulsion used in this layer is chosen to minimize red light reflection, show the highest degree of image sharpness within each set of otherwise identical photographic samples. Specific comparison of the photographic data for samples 201 vs 204; 202 & 203 vs 205; 411 vs 408; 410 vs 409; 412 vs 413; 514 vs 517 and 515 vs 516 serves to illustrate this point.

Further, the samples incorporating an emulsion in the red sensitive layer chosen according to this invention and a quantity of distributed red light absorbing dye sufficient to enable a speed loss of over about 20% enable a surprisingly larger degree of sharpness. Specific comparison of the photographic data for samples 201, 204, 202 & 203 vs 205 and 411, 408, 410 & 412 vs 409 & 413 serves to illustrate this point. Incorporation of lesser quantities of distributed absorber dye does not enable this large degree of sharpness. Specific comparison of the photographic data for samples 514 through 517 serves to illustrate this point.

Photographic Example 3

This example relates to the color reversal processing of Photographic Samples 201 through 205, the preparation of which was previously described.

The samples were exposed exactly as described in Photographic Example 2 to determine the MTF Percent Response as a function of spatial frequency. The samples were developed using the E-6 Color Reversal Process as described at the *British Journal of Photography Annual* for 1982, pages 201-203. This is like the Color Reversal Process described starting at U.S. Pat. No. 4,956,269, column 66, line 46.

Under these exposure and processing conditions the color negative film was totally fogged and showed no discernable image. Films intended for color negative processing are typically not directly compatible with color reversal processing while films designed for color reversal processing are typically not directly compatible with color negative processing. Properly processed color reversal films typically are designed to exhibit much higher gammas and much shorter latitude than are properly processed color negative films.

Additional samples of Photographic Samples 201 through 205 were exposed using the procedure described above but using 120 times the exposure. These were then processed according to the E-6 Color Reversal Process to enable the production of Status M densities like those produced upon Color Negative Processing of these same samples as described in Photographic Example 2. This 120 x increase in exposure enabled the production of a discernable image after the Color Reversal Process and the MTF Percent Response Characteristics were determined for Photographic Samples 201 through 205 as a function of spatial frequency. These results are shown for the cyan dye images formed in the red light sensitive layers in Table 3 below.

TABLE 3

MTF Percent Response of the Red Light Sensitive Layers After Color Reversal Processing as a Function of Film Formulation

| Sample[a] | Tabular (A) | Emulsion[b] (B) | Absorber[c] Dye | MTF Percent Response[d] 2.5 c/mm | 5 c/mm | 50 c/mm | 80 c/mm |
|---|---|---|---|---|---|---|---|
| 201 C | 2.2 × 0.08 | 2.1 × 0.09 | No (100%) | 96 | 76 | 9 | <4 |
| 204 I | 1.7 × 0.15 | 2.0 × 0.14 | No (100%) | 99 | 91 | 12 | <4 |
| 202 C | 2.2 × 0.08 | 2.1 × 0.09 | Yes (60%) | 101 | 97 | 13 | 5 |
| 203 C | 2.2 × 0.08 | 2.1 × 0.09 | Yes (32%) | 102 | 99 | 15 | 7 |
| 205 I | 1.7 × 0.15 | 2.0 × 0.14 | Yes (31%) | 102 | 99 | 16 | 6 |

[a]Samples are identified as comparison (C), or inventive (I).
[b]Dimensions of tabular grain AgX emulsions as average equivalent circular diameter × thickness in the most green light sensitive layer (A) and the most red light sensitive layer (B).
[c]Presence of red light absorbing distributed absorber dye within the film structure. Speed loss induced in the red light sensitive element by presence of the distributed dye is shown in parenthesis and expressed as a percent of the speed of the control element not incorporating the distributed dye.
[d]MTF Percent Response at the indicated spatial frequency in the film plane for the cyan dye images formed in the red light sensitive layers.

As is readily apparent on examination of the photographic data presented in Table 3, the photographic compositions of this invention comprising sensitized high aspect ratio tabular grain emulsions of the preferred grain thickness enable improved sharpness performance at both low and high spatial frequencies when these compositions are developed using a Color Reversal Image forming process. This improvement persists in the presence of distributed absorber dyes. This is true even though the thickness of the film layers was 20.4 microns.

The invention has been described in detail with particular reference to preferred embodiments thereof, but it will be understood that variations and modifications can be effected within the spirit and scope of the invention.

We claim:

1. A photographic recording material comprising a support bearing a photographic layer comprising a sensitized tabular grain silver halide emulsion of aspect ratio greater than 10 sensitized in the red region wherein the thickness of said silver halide emulsion grains is about 0.14 to 0.17 microns thick to minimize the spectral reflectance in the region of the spectrum where the emulsion has its maximum sensitivity.

2. A color photographic recording material comprising a support and at least three photographic elements, each said element being sensitized to different regions of the spectrum;

wherein a layer of at least one photographic element comprises a sensitized tabular grain silver halide emulsion of aspect ratio greater than 10; and wherein said layer of said at least one element is positioned farthest from the exposing image source of all of the most light sensitive layers sensitized to other regions of the spectrum and present in other elements; and wherein the thickness of said tabular silver halide emulsion grains is chosen so as to minimize the spectral reflectance in the region of the spectrum to which said emulsion is sensitized.

3. The material of claim 2 wherein said layer is a most light sensitive layer.

4. The material of claim 2 wherein the photographic recording material further comprises a distributed dye enabling improved sharpness which absorbs light in the region of the spectrum to which a light sensitive layer of an element positioned further from the exposing image source of all of the most light sensitive layers of all of said elements is sensitized.

5. The material of claim 2 wherein the photographic recording material further comprises a spatially fixed absorber dye which absorbs light in the region of the spectrum to which a light sensitive layer of an element positioned further from the exposing image source of all of the most light sensitive layers of all of said elements is sensitized, said spatially fixed absorber dye being positioned between said most light sensitive layer and the exposing image source.

6. The material of claim 1 wherein at least one of conditions A and Condition B enabling improved sharpness is fulfilled;

Condition (A) being that the photographic recording material comprises a distributed dye which absorbs light in the region of the spectrum to which said emulsion is sensitized; and Condition (B) being that the photographic recording material comprises a spatially fixed absorber dye which absorbs light in the region of the spectrum to which said emulsion is sensitized, said spatially fixed absorber dye being positioned between said emulsion and the exposing image source.

7. The material of claims 1 or 2 further comprising a DIR compound.

8. The material of claim 2 wherein the said silver halide emulsion comprises tabular green sensitive grains about 0.11 microns to about 0.13 microns thick.

9. The material of claim 2 wherein the said silver halide emulsion comprises red sensitive tabular grains about 0.14 microns to about 0.17 microns thick.

10. The material of claim 2 wherein the said silver halide emulsion comprises blue sensitive tabular grains about 0.08 to about 0.10 microns thick.

11. The material of claim 2 wherein the thickness of the tabular silver halide emulsion grains in more than one of the most sensitive layers of elements sensitive to different regions of the spectrum is chosen so as to minimize the spectral reflectance in the region of the spectrum to which each said emulsion is sensitized.

12. The material of claim 11 wherein at least one of condition A and condition B enabling improved sharpness is fulfilled;

Condition (A) being that the material comprises at least one distributed absorber dye which absorbs light in the region to which at least one of said emulsions is sensitized; and Condition (B) being that the material comprises at least one spatially fixed absorber dye which absorbs light in the region of the spectrum to which at least one of said emulsions is sensitized, said spatially fixed absorber dye being positioned between said emulsion and the exposing image source.

13. The material of claims 1 or 2 wherein said tabular silver halide emulsion has a Tabularity greater than about 50.

14. The material of claims 1 or 2 wherein said silver halide emulsion is a silver iodobromide emulsion.

15. The photographic recording material of claims 1 or 2 wherein said recording material comprises a color negative film.

16. The material of claim 2 wherein the said silver halide emulsion comprises red sensitive tabular grains about 0.28 to about 0.30 microns thick.

17. The material of claim 2 wherein the said silver halide emulsion comprises green sensitive tabular grains about 0.23 to about 0.25 microns thick.

18. The material of claim 2 wherein the said silver halide emulsiuon comprises blue sensitive tabular grains about 0.19 to about 0.21 microns thick.

* * * * *